US006047487A

United States Patent [19]

Clendenning

[11] Patent Number: 6,047,487

[45] Date of Patent: Apr. 11, 2000

[54] MULTIPIECE EXCAVATING TOOTH ASSEMBLY

[75] Inventor: Charles Clendenning, Broken Arrow, Okla.

[73] Assignee: H&L Tooth Co., Tulsa, Okla.

[21] Appl. No.: 09/118,658

[22] Filed: Jul. 17, 1998

[51] Int. Cl.[7] ..... E02F 9/28

[52] U.S. Cl. ..... 37/452; 37/455

[58] Field of Search ..... 37/452, 453, 454, 37/460, 455

[56] References Cited

U.S. PATENT DOCUMENTS

| | | | |
|---|---|---|---|
| 1,909,850 | 5/1933 | Younie | 37/454 |
| 2,118,872 | 5/1938 | Weimer | 37/454 |
| 2,227,674 | 1/1941 | Ratkowski | 37/454 |
| 3,091,044 | 5/1963 | Penote et al. . | |
| 3,117,386 | 1/1964 | Ferwerda | 37/454 |
| 3,297,365 | 1/1967 | Proctor . | |
| 4,317,300 | 3/1982 | Emrich et al. | 37/453 |
| 4,481,728 | 11/1984 | Mulder et al. | 37/452 |
| 4,611,418 | 9/1986 | Launder . | |
| 4,711,503 | 12/1987 | Berchem et al. | 37/142 |
| 4,965,945 | 10/1990 | Emrich . | |
| 5,016,365 | 5/1991 | Robinson | 37/453 |
| 5,074,062 | 12/1991 | Hahn et al. . | |
| 5,177,886 | 1/1993 | Klett . | |
| 5,224,282 | 7/1993 | Swick | 37/454 |
| 5,469,648 | 11/1995 | Jones et al. . | |
| 5,666,748 | 9/1997 | Emrich et al. | 37/453 |
| 5,778,570 | 7/1998 | Eichelberger | 37/454 |

FOREIGN PATENT DOCUMENTS

| | | | |
|---|---|---|---|
| 000999895 | 11/1976 | Canada | 37/453 |
| 2264140 | 3/1974 | France . | |
| 002938119 | 4/1981 | Germany | 37/454 |
| 0038389062 | 5/1990 | Germany | 37/454 |
| 43 45 100A1 | 12/1993 | Germany . | |

*Primary Examiner*—Thomas B. Will
*Assistant Examiner*—Kristine M Markovich
*Attorney, Agent, or Firm*—J. W. Harbst

[57] ABSTRACT

A multipiece excavating tooth assembly including an adapter, a digging or excavating tooth, and retaining pin structure for interconnecting the adapter and tooth in operable combination relative to each other. The tooth and adapter have a uniquely configured interface or conjuncture therebetween. Moreover, the conjuncture between the digging tooth and adapter is configured to advantageously orientate the retaining pin structure to avoid those problems inherent with conventional vertical and horizontal pin systems.

63 Claims, 13 Drawing Sheets

MULTIPIECE EXCAVATING TOOTH ASSEMBLY

FIELD OF THE INVENTION

The present invention generally relates to ground engaging equipment and, more specifically, to a multipiece excavating tooth assembly including an excavation tooth and adapter operably interconnected relative to each other by retaining pin structure.

BACKGROUND OF THE INVENTION

Excavating equipment used in mining, construction, and a myriad of other ground engaging operations, typically includes a series of spaced apart ground engaging teeth mounted in side-by-side relation across a bucket lip. The teeth project forwardly to engage and break up the material to be gathered in the bucket. The art recognized long ago the advantages to be obtained by connecting the relatively small digging or excavating tooth to a relatively large adapter or support which, in turn, is connected to the bucket or excavating equipment. Typically, the adapter or support includes a base portion configured for attachment to the forward lip of a bucket and a free ended nose portion. In many applications, the conjuncture between the digging tooth and adapter involves providing the digging or excavating tooth with a pocket or cavity which opens to the rear of the tooth and fits over and along a substantial length of the nose portion of the adapter. A suitable pin operably interconnects the tooth and adapter in operable relationship relative to each other.

Typically, and especially in today's global economy, the components comprising a ground engaging multipiece tooth assembly are manufactured and/or fabricated in various global locations. That is, a digging tooth or tip can be manufactured or fabricated in one part of the world, i.e., China while the adapter or support for the tooth can be independently manufactured or fabricated in another part of the world, i.e., Mexico. It is common for these separate parts or components of the digging tooth assembly to be brought together only where the machine or apparatus on which they are to be arranged in manufactured and assembled. Accordingly, the parts or components of the multipiece tooth assembly require liberal tolerances to enable the parts fabricated at various global manufacturing facilities to fit and operate in combination relative to each other.

As will be appreciated by those skilled in the art, when connected to a bucket or the like, excavating tooth assemblies are often subject to highly abrasive conditions and, thus, experience rapid and considerable wear. Moreover, the relative high forces developed during operation of the excavating tooth assembly furthermore add to the rapid wear of the component parts of the excavating tooth assembly. Typically, each digging tooth is provided with a cutting edge extending across a forward edge of the tooth to facilitate penetration and breakup of the ground. The cutting edge of each tooth is oriented to extend transversely of the tooth and in generally parallel relationship with the work surface being excavated or dug.

In service, and although specific steps may have been applied to the tooth during its fabrication, the forward cutting edge of the tooth wears and quickly becomes dull and inefficient in the digging operation and, thus, require replacement. The multipiece construction of a tooth assembly advantageously allows the digging or excavating tooth of the assembly to be replaced independent of the adapter. Depending upon the type of excavation involved, a given adapter can be successively equipped with anywhere from five to thirty replacement teeth to maintain sharp penetrating edges. In the field, replacement of worn excavating tooth parts is a common and sometimes daily experience.

As can be appreciated, during an excavating, digging or loading operation extremely high vertical forces are imparted to each excavating tooth assembly associated with the excavating equipment. A conventional adapter or support has generally flat top and bottom surfaces upon which corresponding flat surfaces of the digging tooth bear upon. Under extreme loading conditions, and although interconnected through a pin or the like, the digging or excavating tooth tends to move forwardly and downwardly relative to the nose portion of the adapter. The loose fit between the component parts furthermore adds to relative movement between the tooth and adapter or support. The tendency of the tooth to move relative to the adapter exacerbates the wear problem especially in the pocket area and along the nose portion of the adapter. The existence of dust and dirt between the sliding confronting surfaces on the digging tooth and adapter furthermore adds to the deterioration of the component parts of the excavating tooth assembly. Thus, the critical conjuncture between the digging tooth and adapter is subject to accelerated wear conditions which can result in tooth pocket failure and/or premature adapter replacement.

While the vertical loads imparted to each tooth assembly during a ground engaging operation are significant, the horizontal or lateral loading imparted to the teeth are also of concern. For example, and as will be appreciated, the horizontal loads and forces imparted to a digging tooth affixed to a ripper and the like ground engaging equipment can be significant. Accordingly, each digging tooth assembly needs to be configured to accommodate both horizontal and vertical loads imparted thereto during normal operation. Of course, if the excavating tooth should break during operation, intermingling of a broken tooth component with the remainder of the excavated materials can cause significant material handling problems in subsequent operations, i.e., crushing operations. If a tooth or point is lost, the adapter quickly will become damaged as the nose portion of the adapter is not made to resist highly abrasive conditions. Moreover, and especially when considering excavator buckets or loaders, the horizontal width of each tooth assembly needs to be controlled in order to accommodate an adequate number of teeth along a forward edge or lip of the excavating equipment or bucket.

The securement of the excavating or digging tooth to the adapter requires a compromise between two opposing demands. On the one hand, the method of securing the tooth to the adapter must be strong enough to maintain the tooth and adapter in operable relationship notwithstanding the tremendous shock loads encountered during an excavating operation. Yet, when replacement of the tooth is required or desired, the pin for securing the tooth to the adapter must be readily removable. Often times, and especially in field conditions, removal/replacement of the retaining pin is accomplished under rather primitive conditions. Typically, the retaining pin has to be removed with only a hammer and drift pin which makes it difficult to overcome a tightly held locking engagement.

Heretofore, known pinning systems for securing an excavating tooth to an adapter have involved inserting a pin or multiple shorter pins either horizontally or vertically through openings in the tooth and adapter. Vertically oriented pin systems advantageously provide enhanced access to the pin. While providing enhanced access for striking the retaining pin with a hammer, the vertical orientation of the retaining pin exposes the retaining pin to rock and other media being excavated causing pin wear and, in some extreme cases, dislodgement of the retaining pin. Moreover, with vertical pin retention systems, the vertical movements of the excavating equipment tend to work against the vertically oriented pin system causing it to wear and, in some extreme cases, to become dislodged thereby allowing the tooth and adapter to become inadvertently separated during an excavating operation.

Horizontal pinning systems, while allowing for secure attachment of the digging tooth and adapter, also have certain drawbacks associated therewith. As will be appreciated, when secured across a front edge or lip of excavating equipment, the lateral or horizontal spacing between adjacent digging tooth assemblies and/or wear shrouds is minimized. Such tight space constraints make it difficult to horizontally drive a horizontally disposed retaining pin during installation and removal of the digging teeth. In fact, separate industries specifically directed to the problem of driving horizontal retaining pins relative to the digging tooth assembly are known and special devices have been proposed to address the problems inherent with horizontal pinning systems.

Thus, there is a need and a desire for a digging tooth assembly offering enhanced strength characteristics capable of handling extreme loading conditions imparted to the tooth assembly during a excavating operations and whose configuration lends itself to a pinning system which avoids the problems and difficulties associated with heretofore known horizontal and vertical pinning systems.

SUMMARY OF THE INVENTION

In view of the above, and in accordance with the present invention, there is provided a multipiece excavating tooth assembly including an adapter, a digging or excavating tooth, and pin structure for interconnecting said adapter and tooth in operable combination relative to each other. The tooth and adapter have a uniquely configured interface or conjuncture therebetween. Moreover, the conjuncture between the digging tooth and adapter is configured to advantageously orientate the pin structure to avoid those problems inherent with both vertical and horizontal pin systems described above while yielding other heretofore unknown advantages.

The adapter for the multipiece tooth assembly of the present invention has a base portion and a nose portion axially aligned relative to each other along a longitudinal centerline. The base portion of the adapter is configured to permit attachment of the adapter to excavating equipment. According to one aspect of the present invention, the nose portion of the adapter has top and bottom angled surfaces disposed above and below the longitudinal centerline of the adapter, respectively. At least the top surface on the nose portion of the adapter has two angled sides or facets joined to each other along and diverging relative to a common edge longitudinally extending forwardly from a rear end of and for a lengthwise distance of the nose portion. Each side or facet forming the top surface on the adapter is arranged on opposite lateral sides of the longitudinal centerline of the adapter. The adapter is further configured to accommodate the pin structure used to releasably fasten and hold the digging or excavating tooth and adapter in operable combination relative to each other. In a preferred form of the invention, the bottom surface of the nose portion of the adapter has two sides or facets which are likewise joined to each other along and diverging relative to a common edge longitudinally extending forwardly from a rear end of and for a lengthwise distance of the nose portion of the adapter. Like those on the top surface, the sides or facets on the bottom surface of the nose portion of the adapter are arranged on opposite lateral sides of the longitudinal axis of the adapter.

The digging tooth of the excavating tooth assembly of the present invention has a forward end and a rearward end. The rearward end of the tooth defines a blind cavity or socket configured to accommodate a major lengthwise section of the nose portion of the adapter therewithin. The digging or excavating tooth is further configured to cooperate with the configuration on the adapter for accommodating the pin structure.

The pin structure for holding the adapter and digging tooth in operable combination relative to each other can take a myriad of different designs without detracting or departing from the spirit and scope of the present invention. In one form, the retaining pin preferably has an elongated configuration allowing the pin to pass endwise through a bore in the adapter and extend at least partially into axially aligned holes defined by the digging tooth. Alternatively, the pin structure can include a pin which partially extends through axially aligned holes on the digging tooth and operably engages, intermediate opposite ends thereof, an open channel on an outer ridge defined on the adapter. In another form, the pin structure can take the form of a displaceable detent or pin which passes into a recess formed on the adapter and extends into releasable association with a recess on the tooth thereby maintaining the digging tooth and adapter in operable association relative to each other. As will be appreciated by those skilled in the art, the pin structure further includes some form of mechanism or device for inhibiting inadvertent endwise movement of the retaining pin relative to the adapter and tooth.

The adapter and digging tooth of the excavating tooth assembly are preferably configured with supports for stabilizing the tooth assembly during an excavating operation. In a preferred form, the supports for stabilizing the tooth and adapter each include generally horizontal and generally vertical surfaces provided on the top and bottom surfaces of the adapter and corresponding areas of the tooth.

In a preferred form of the invention, the two sides forming the top surface on the nose portion of the adapter are downwardly disposed or angled and have a generally planar configuration for adding stability at the conjuncture between the tooth and adapter. Moreover, the two sides of the bottom surface on the nose portion of the adapter are preferably upwardly disposed or angled and likewise have a generally planar configuration to furthermore add stability to the conjuncture between the adapter and digging tooth. To compliment the tooth design which typically embodies a generally wedge shaped profile, the sides or facets of the top and bottom surfaces slope downwardly toward a free end of the nose portion of the adapter such that they are disposed at a converging angle relative to each other. To add strength, durability and rigidity thereto, the adapter is preferably formed as a result of a forging operation.

A preferred form of the present invention provides the nose portion of the adapter with a quadrilaterally shaped cross sectional configuration. In a most preferred form of the invention, the four sided nose portion of the adapter has a cross-sectional configuration of an equilateral parallelogram. Unlike heretofore known nose portions on other adapters, however, the quadrilaterally shaped cross sectional shape or configuration of the nose portion of a preferred form of the invention is offset at an angle ranging between about 25° to about 65° relative to the orientation of the base portion of the adapter. Preferably, the quadrilateral cross section of the nose portion of the adapter is offset at an angle of about 45° relative to the base portion of the adapter. With the present design, the common edges joining the sides of the top and bottom surfaces of the nose portion of the adapter can be spaced apart by a first distance which is greater than a second distance separating the diametrically opposed and longitudinally extending common edges joining the sides of the top and bottom surfaces of the nose portion of the adapter arranged to one or the other lateral side of the longitudinal centerline of the adapter. This uniquely configured design enhances the strength of the nose portion of the adapter thereby adding to its durability and operable usefulness.

As is typical, the tip or tooth of the excavating tooth assembly has a generally wedge shaped side profile. The tooth has a ground penetrating edge extending transversely across a forward end thereof to enhance penetration of an earthen surface and which extends generally parallel to an edge or lip of the excavating equipment or bucket to which it is connected. As mentioned above, the rear end of the digging tooth defines a blind cavity which opens to a rear end of the tooth and allows the nose portion of the adapter to be slidably accommodated therewithin.

Another aspect of the present invention relates to the configuration of the rear end and, more specifically, the configuration of the cavity forming part of the conjuncture between the tooth and the adapter. The blind cavity defined by the digging tooth includes top and bottom surfaces disposed to opposite sides of a longitudinal centerline of the tooth. In one form of the invention, the cross sectional configuration of the cavity defined at the rear end of the tooth compliments the cross sectional configuration of the nose portion of the adapter.

In the illustrated embodiment, the top surface of the cavity in the tooth is defined by two sides or facets; with each side or facet extending at an acute angle ranging between about 25° and about 65° relative to the ground penetrating edge of the tooth. Each angled side forming the top surface of the cavity or socket defined by the tooth is arranged on opposite lateral sides of the longitudinal centerline of the tooth and has a common edge extending therebetween. In a preferred form of the invention, the bottom or lower surface of the cavity in the tooth is likewise defined by two sides or facets; with each side or facet extending at an acute angle ranging between about 25° and about 65° relative to the ground penetrating edge of the tooth. Each angled side forming the bottom or lower surface of the cavity or socket defined by the tooth is arranged on opposite lateral sides of the longitudinal centerline of the tooth and has a common edge extending therebetween. The digging tooth furthermore defines a recess configured to accommodate a retaining pin structure defining an axis preferably extending generally normal to one of the sides or facets of the top surface of the blind cavity defined by the tooth.

In a preferred form of the invention, the two sides forming the top surface of the blind cavity defined by the tooth have generally planar configurations. Moreover, and in those embodiments so configured, each side defining the bottom surface of the blind cavity of the tooth likewise preferably has a planar configuration. In this preferred design, the blind cavity defined by the tooth has a quadrilaterally shaped cross sectional configuration along a major lengthwise portion thereof. As will, be appreciated, the quadrilateral cross-section configuration of the cavity defined by the tooth provides any two sides of the top and bottom surfaces to be joined along a common edge. Moreover, in a preferred form of the invention, the four sided cavity defined by the tooth has a cross-section configuration of an equilateral parallelogram. Notably, the quadrilaterally shaped cross sectional configuration of the cavity is offset at an angle ranging between about 25° and about 65° relative to the transverse ground engaging edge of the tooth. In a most preferred form of the invention, the digging tooth is fabricated using a forging process so as to enhance the strength, rigidity and wearability thereof in harsh and demanding environments.

In one form of the invention, and to accommodate certain types of retaining pin structure described above, a bore, defined in the nose portion of the adapter and aligned holes in the digging tooth are complementarily disposed relative to each other to accommodate endwise passage of and thereafter maintain an elongated retaining pin in operable association with the tooth and adapter. According to another aspect of the present invention, the bore defined by the nose portion of the adapter is disposed along an axis intersecting opposite lateral sides of the top and bottom surfaces of the nose portion of the adapter. According to still another aspect of the present invention, the recess defined by the digging tooth, for accommodating at least a portion of the retaining pin structure therewithin, defines an axis disposed at an angle ranging between about 25° and 65° relative to the forward cutting edge on the tooth.

With the various embodiments of the invention, the axis of the retaining pin structure preferably extends generally normal to one side or facet of the top surface of the nose portion of the adapter or blind cavity of the tooth, respectively. This slanted or canted orientation of the retaining pin structure offers several heretofore unknown advantages. First, the slanted orientation of the pin structure offers ergonomic advantages during repair and replacement of the digging tooth and especially as involving insertion and removal of the retaining pin structure. Such ergonomic advantages are even more apparent depending upon the disposition of the bucket or implement on which the digging tooth is to be repaired and/or replaced. Moreover, the slanted orientation of the retaining pin structure yields a visual indication of the proper orientation of the digging tooth relative to the adapter during assembly of the digging tooth assembly. As will be appreciated by those skilled in the art, certain digging or excavating teeth are purposefully designed with a specific angle of attack relative to the bucket or ground engaging implement on which it is mounted. Often times, the digging tooth is mounted incorrectly to the bucket, thus, losing the advantages for which it was specifically designed. With the present invention, the slanted orientation of the pin structure provides for proper orientation of the tooth and adapter during assembly thus allowing the user to take full advantage of the benefits specifically designed into the digging tooth.

As will be appreciated from an understanding of the present invention, and as described in further detail below, the angular orientation of those components of the digging tooth and adapter forming the conjuncture therebetween have been significantly modified from previous digging tooth assembly designs to purposefully distinguish this design from the prior art while concurrently offering superior strength to the conjuncture therebetween. The angled disposition of the facets forming the top surface of the nose portion of the adapter and the blind cavity in the tooth advantageously promotes a self-centering effect for the loose fit between the tooth and adapter. Additionally, the angled disposition of the facets forming the top surface on the nose portion of the adapter and the top surface of the cavity in the tooth yields an increase in surface area contact (as compared to similarly shaped cross sectional areas oriented or disposed in line with the base portion of the adapter and the leading edge of the tooth) at the conjuncture between the component parts of the tooth assembly thereby adding to the ability of the parts to distribute the loads imparted thereto during ground engaging operations over a broader area.

The angled modification of the component parts forming the conjuncture between the tooth and adapter furthermore advantageously disposes the retaining pin structure at other than a strict and limiting vertical or horizontal orientation. Rather than conform to previous configurations, the angular offset relation offered to the component parts of the conjuncture of the present invention permits the retaining pin to be likewise offset at an angle relative to the horizontal ranging between about 25° and about 65° relative to a horizontal plane thus yielding those advantages mentioned above along with others. That is, with the angular orientation of the pin structure, the materials being excavated and the vertical movements or digging forces of the excavating equipment normally imparted to vertically oriented pin structures will have a significantly lesser adverse effect on the retaining pin structure of the present invention during excavating operations. Another advantage to be appreciated from the new design disclosed by the present invention relates to the enhanced space it provides for substantially unencumbered access to the retaining pin as compared to those digging or excavating tooth designs wherein the retaining pin is disposed in a generally horizontal orientation.

These and numerous other objects, aims, and advantages of the present invention will become readily apparent from the following detailed description, the drawings, and the appended claims.

DETAILED DESCRIPTION OF THE DRAWINGS

Figure 7:
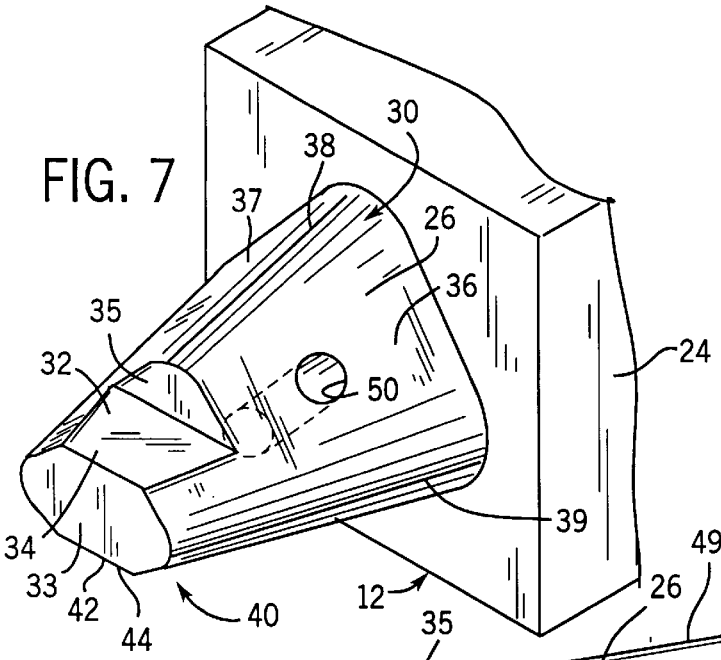
FIG. 7 is a perspective view of the adapter illustrated in FIGS. 4 through 6.
Figure 6:
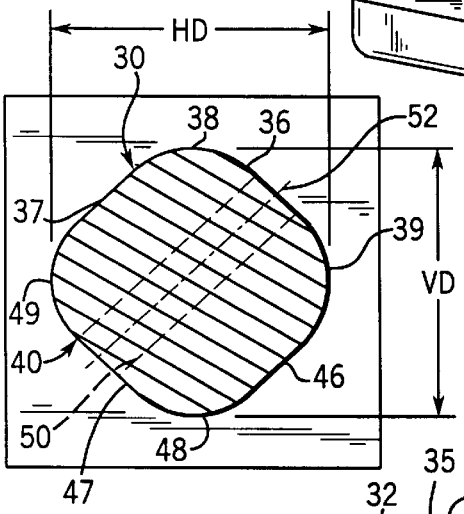
FIG. 6 is a sectional view taken along line 6—6 of FIG. 5.
Figure 26:
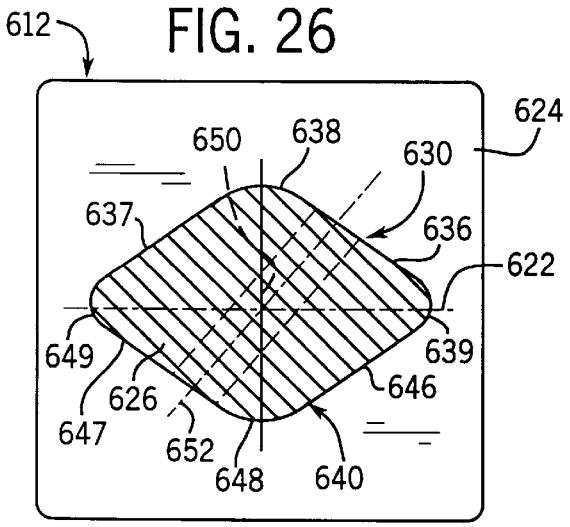
Figure 27:
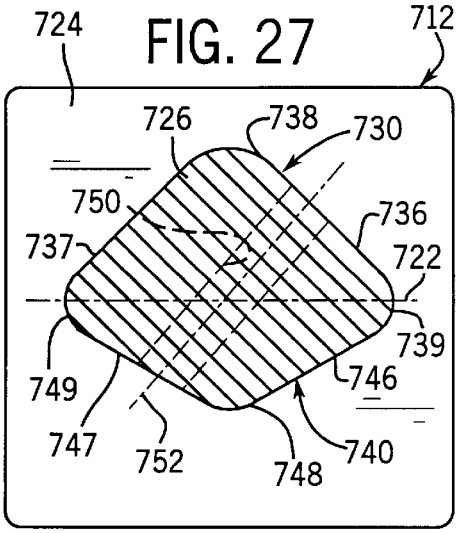
Figure 21:
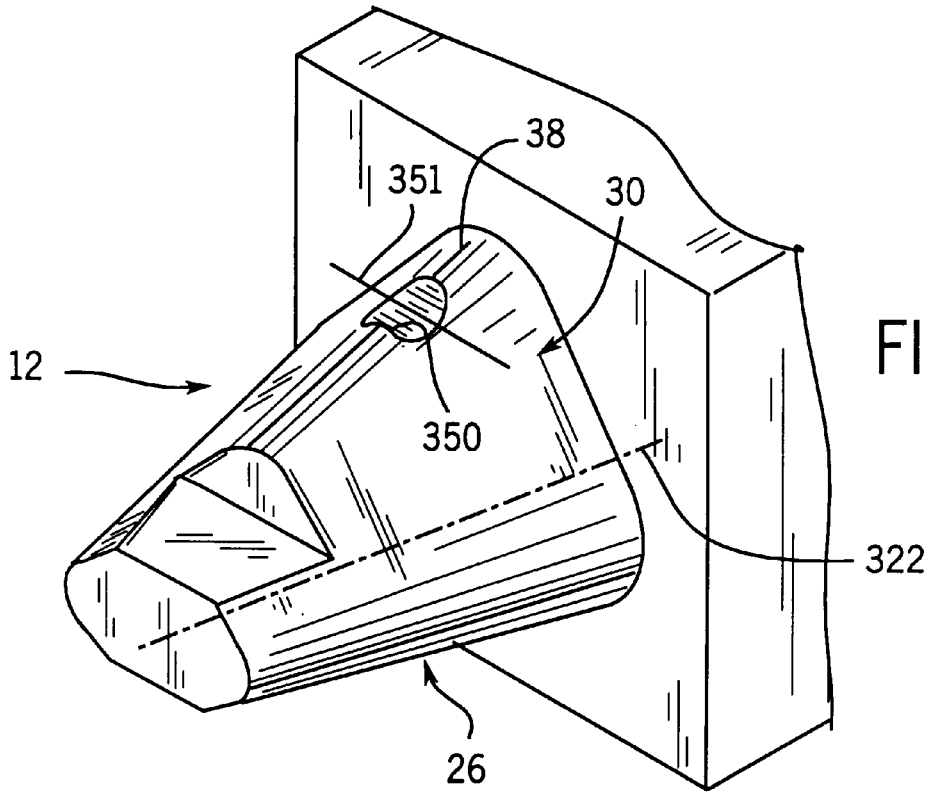
Figure 20:
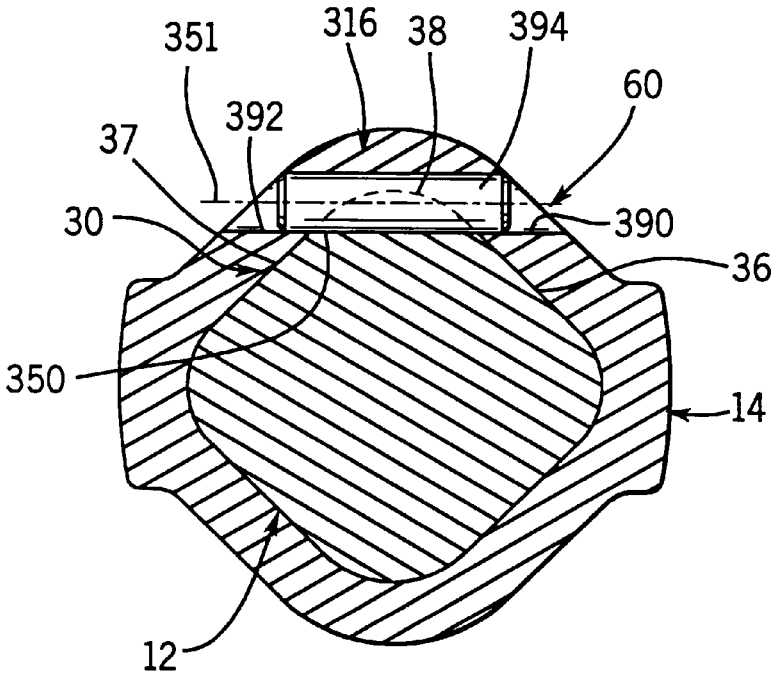
Figure 23:
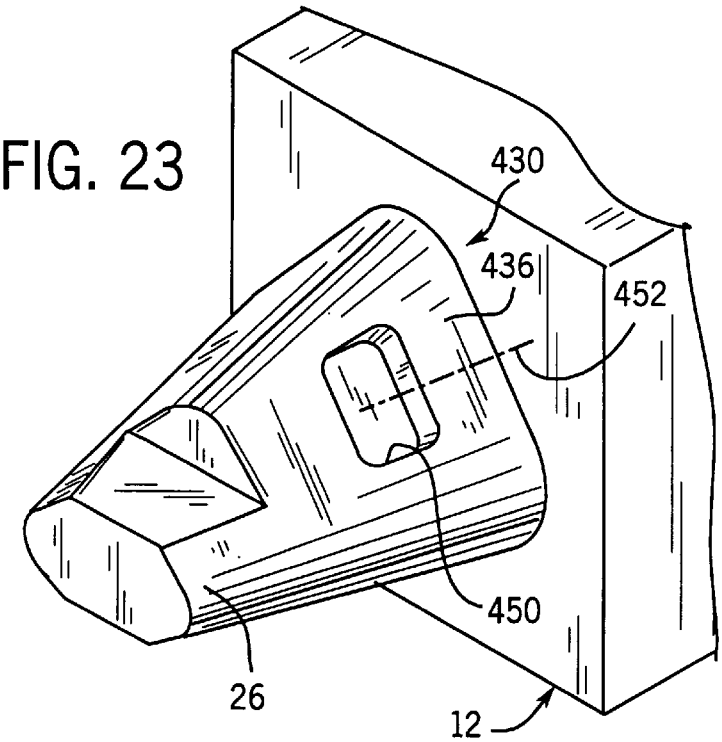
Figure 22:
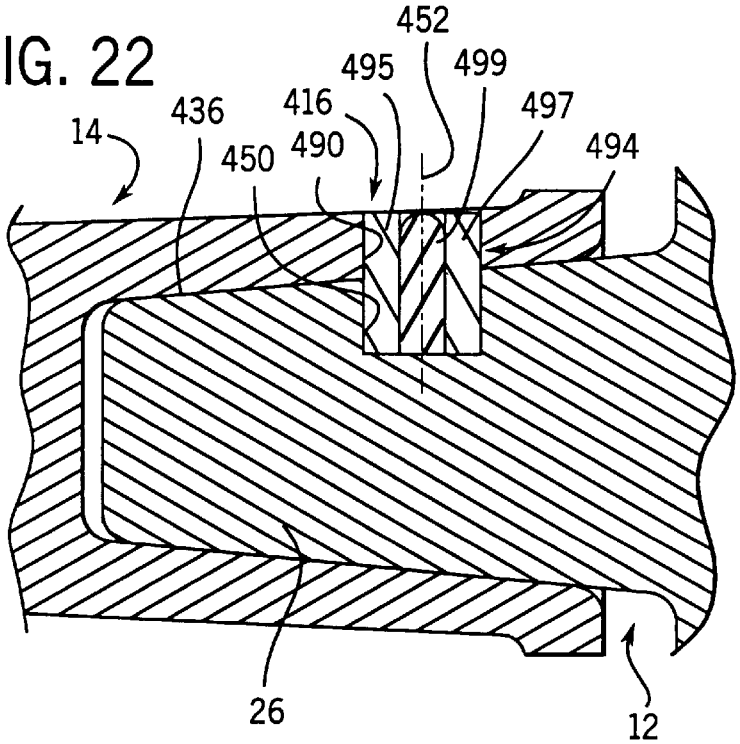
Figure 24:
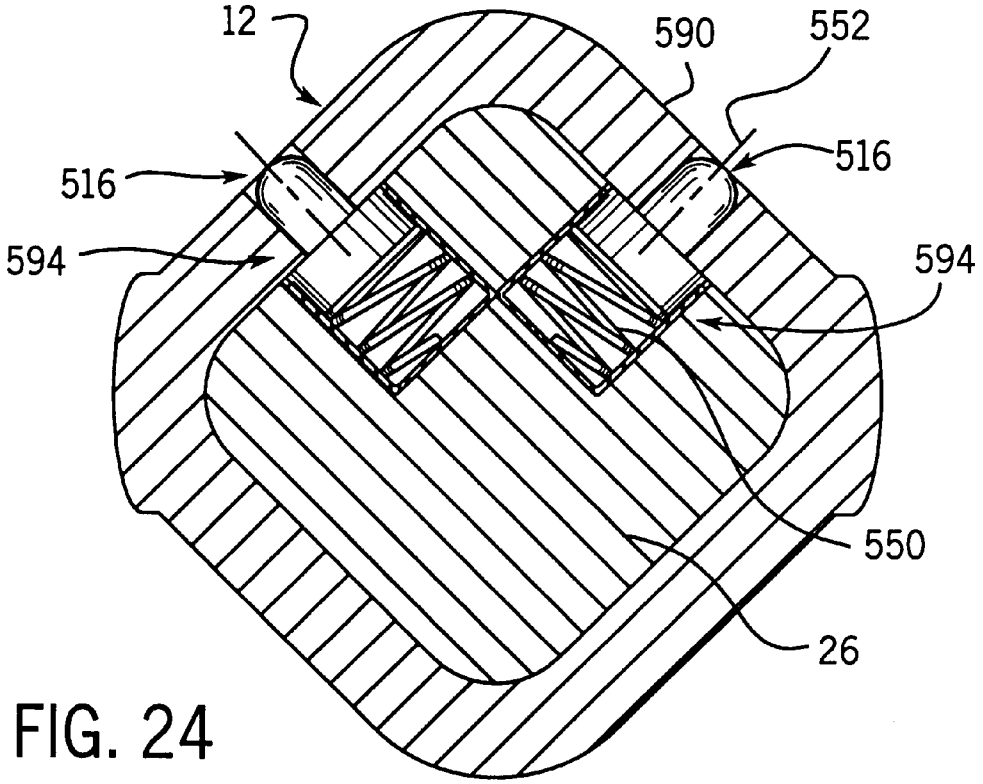
Figure 25:
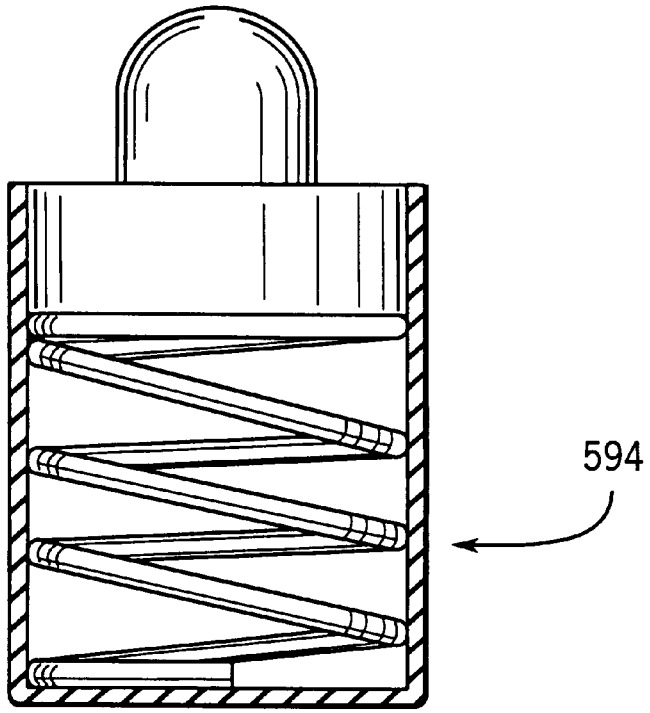
Figure 28:
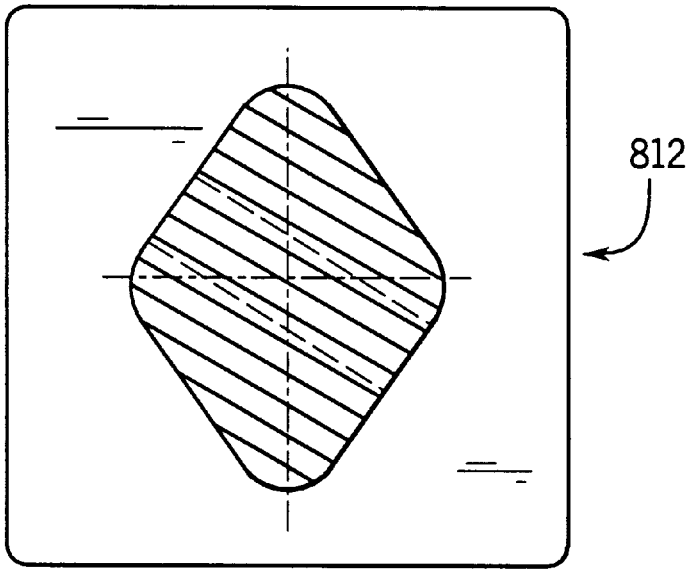
Figure 29:
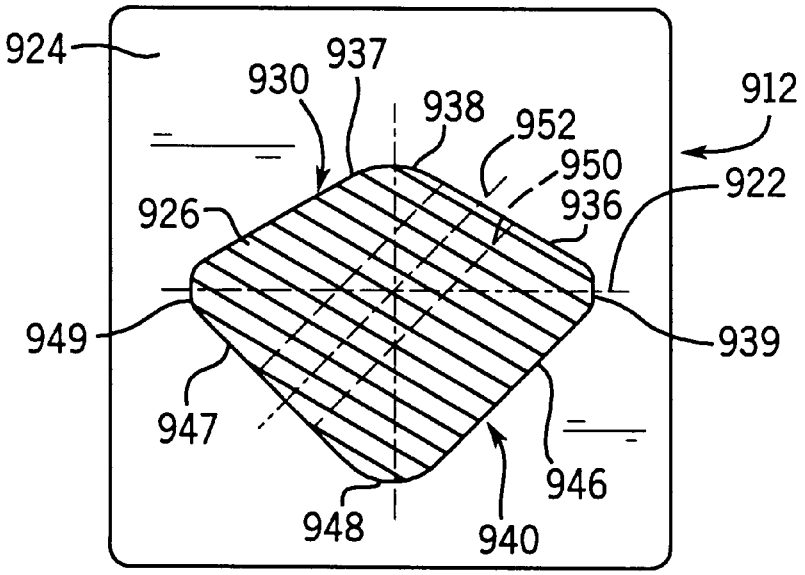
Figure 30:
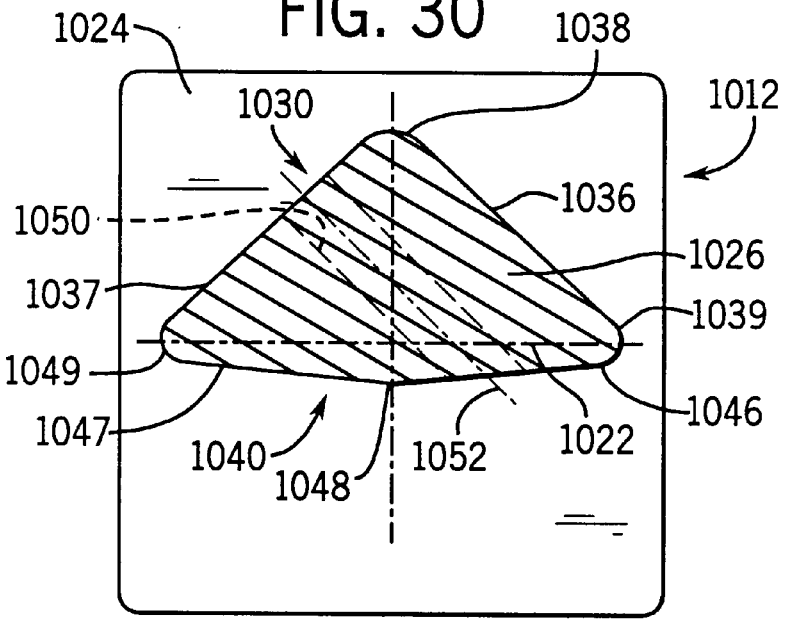
Figure 31:
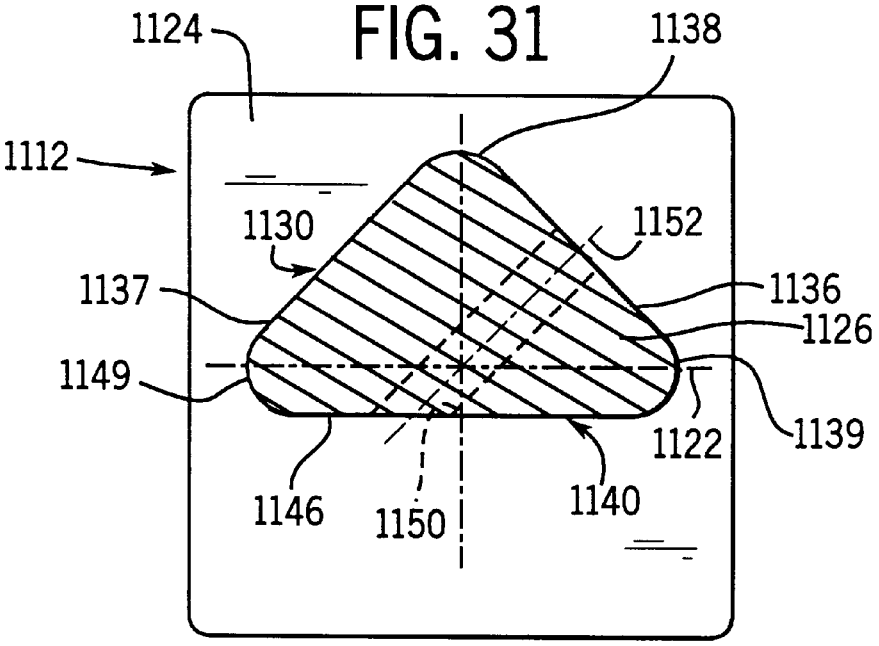

FIG. 20 is a transverse cross-sectional view of a nose portion of an adapter embodying features of the present invention and showing an alternative form of retainer pin structure for releasably fastening a digging tooth in operable association with the adapter, FIG. 21 is a view similar to FIG. 7 showing a perspective view of a nose portion of the adapter illustrated in FIG. 20 and capable of accommodating the alternative pin retaining structure illustrated in FIG. 20;

FIG. 22 is a longitudinal sectional view of an adapter having an alternative form of retainer pin structure for releasably fastening a nose portion of an adapter and a digging tooth fitted in operable combination relative to each other;

FIG. 23 is a view similar to FIG. 21 showing a perspective view of a nose portion of the adapter illustrated in FIG. 22 and capable of accommodating the alternative form of retaining pin structure;

FIG. 24 is an enlarged transverse cross-sectional view similar to FIG. 20 showing a nose portion of an adapter with a digging tooth fitted thereabout and showing still another alternative pin structure for releasably holding and maintaining the adapter and digging tooth in operable combination relative to each other;

FIG. 25 is an enlarged side elevational view of the retainer pin structure illustrated in FIG. 24;

FIG. 26 is a sectional view similar to FIG. 6 but showing another alternative cross-sectional configuration for a nose portion of the adapter;

FIG. 27 is another sectional view similar to FIG. 6 but showing still another alternative cross-sectional configuration for a nose portion of the adapter;

FIG. 28 is a sectional view similar to FIG. 6 but showing yet another alternative cross-sectional configuration for a nose portion of the adapter;

FIG. 29 is a sectional view similar to FIG. 6 but showing yet another alternative cross-sectional configuration for a nose portion of the adapter;

FIG. 30 is another sectional view similar to FIG. 6 but showing yet another alternative cross-sectional configuration for a nose portion of the adapter; and FIG. 31 is another sectional view similar to FIG. 6 but showing yet another alternative cross-sectional configuration for a nose portion of the adapter.

DETAILED DESCRIPTION OF THE PRESENT INVENTION

While the present invention is susceptible of embodiment in multiple forms, there are shown in the drawings and will hereinafter be described various preferred embodiments of the present invention with the understanding the present disclosure is to be considered as setting forth exemplifications of the invention which are not intended to limit the invention to the specific embodiments illustrated and described.

Figure 1:
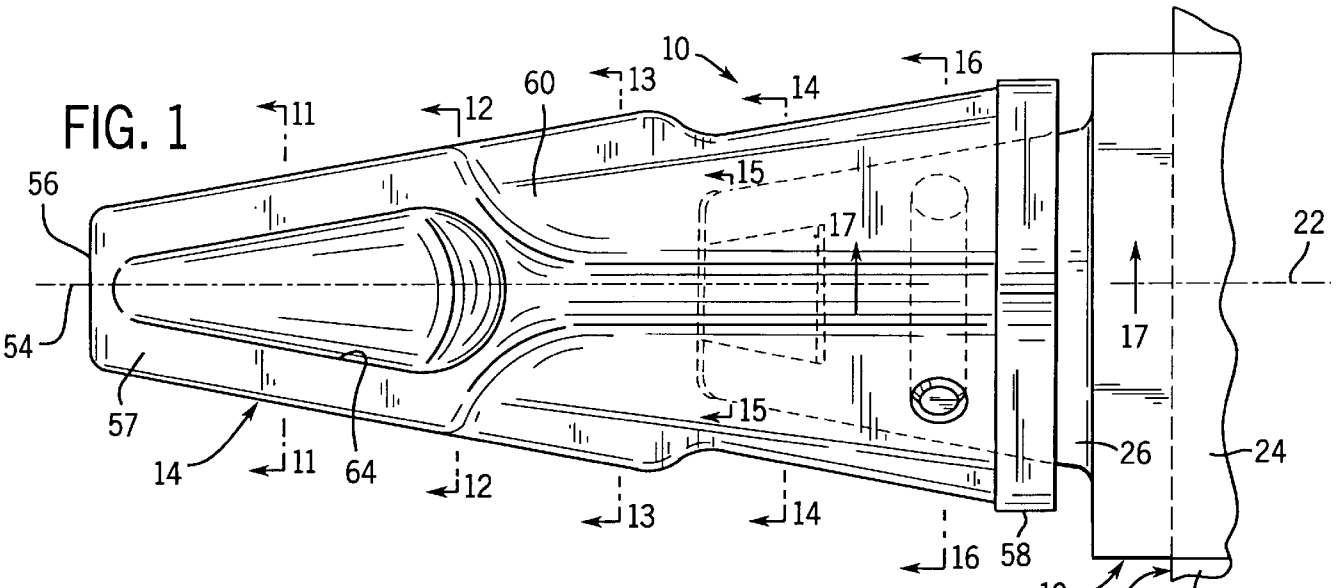
FIG. 1 is a top plan view of the excavating tooth assembly of the present invention.
Figure 2:
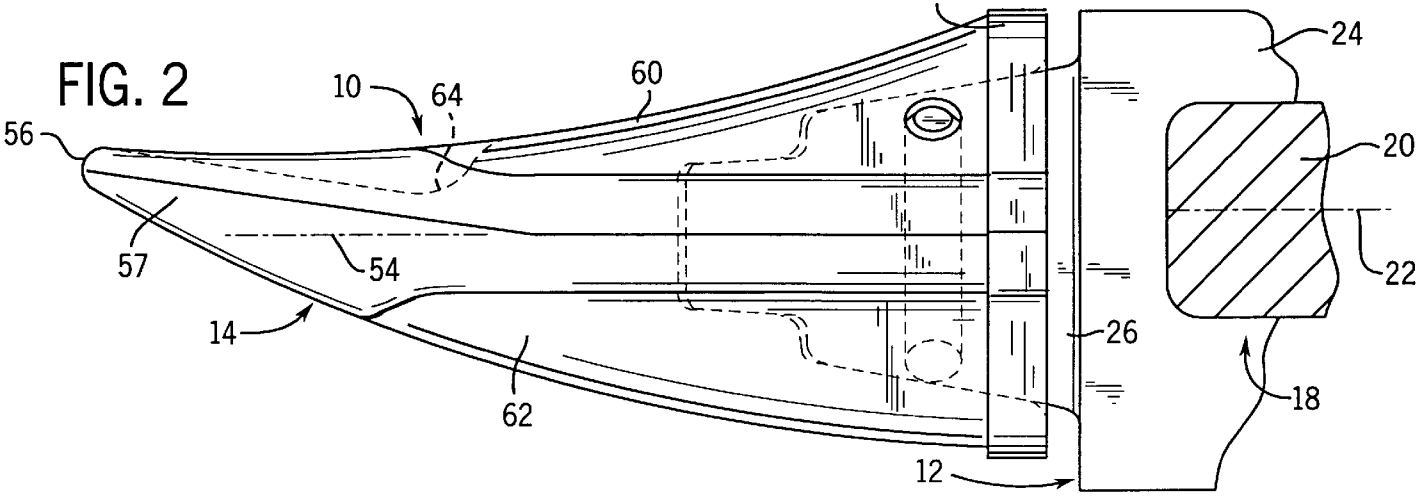
FIG. 2 is a side elevational view of the excavating tooth assembly illustrated in FIG. 1.

Referring now to the drawings, wherein like reference numerals indicate like parts throughout the several views, there is illustrated in FIG. 1 an excavating tooth assembly 10 embodying various principles and varying aspects of the present invention. As shown, the excavating tooth assembly 10 is of multiple piece construction and includes an adapter or support 12 and an excavating tooth 14 held in one position or orientation relative to each other. In the embodiment illustrated in FIG. 1, a retainer pin apparatus 16 releasably interconnects and maintains the adapter 12 and excavating tooth 14 in operable combination relative to each other.

Although only a single excavating tooth assembly is shown in FIG. 1 as being attached to excavating equipment 18, such as a forward lip 20 of an excavating bucket or the like, it will be understood by those skilled in the art that on a typical piece of excavating equipment, a plurality of laterally spaced tooth assemblies, substantially identical to tooth assembly 10, would extend forwardly from the bucket lip 20 in a ground engaging orientation. Moreover, and as will be appreciated by those skilled in the art, the bucket, shovel or other piece of excavating equipment to which the excavating tooth assembly 10 is connected moves both vertically and horizontally during an excavating operation.

As illustrated in FIGS. 1 through 4, the adapter or support 12 has an elongated free ended configuration defining a longitudinal centerline 22. The adapter or support 12 includes a conventional base portion 24 and an axially aligned nose portion 26 extending forwardly from the base portion 24 in a cantilevered fashion from the forward edge or lip 20 of the ground excavating apparatus or bucket 18. The base portion 24 of the adapter 12 is configured for attachment to the ground engaging apparatus 18. On some larger forms of equipment, the base portion 24 of the adapter 12 is configured for releasable securement, such as by a conventional wedge locking mechanism (not shown), to the forward lip 20 of the shovel or dipper bucket 18 of the earth excavation apparatus. As is typical, the excavating tooth 14 fits endwise along and about the nose portion 26 of the adapter 12. In a preferred form, the adapter 12 is formed as a result of a forging operation thereby adding strength and rigidity to the adapter 12.

Figure 3:
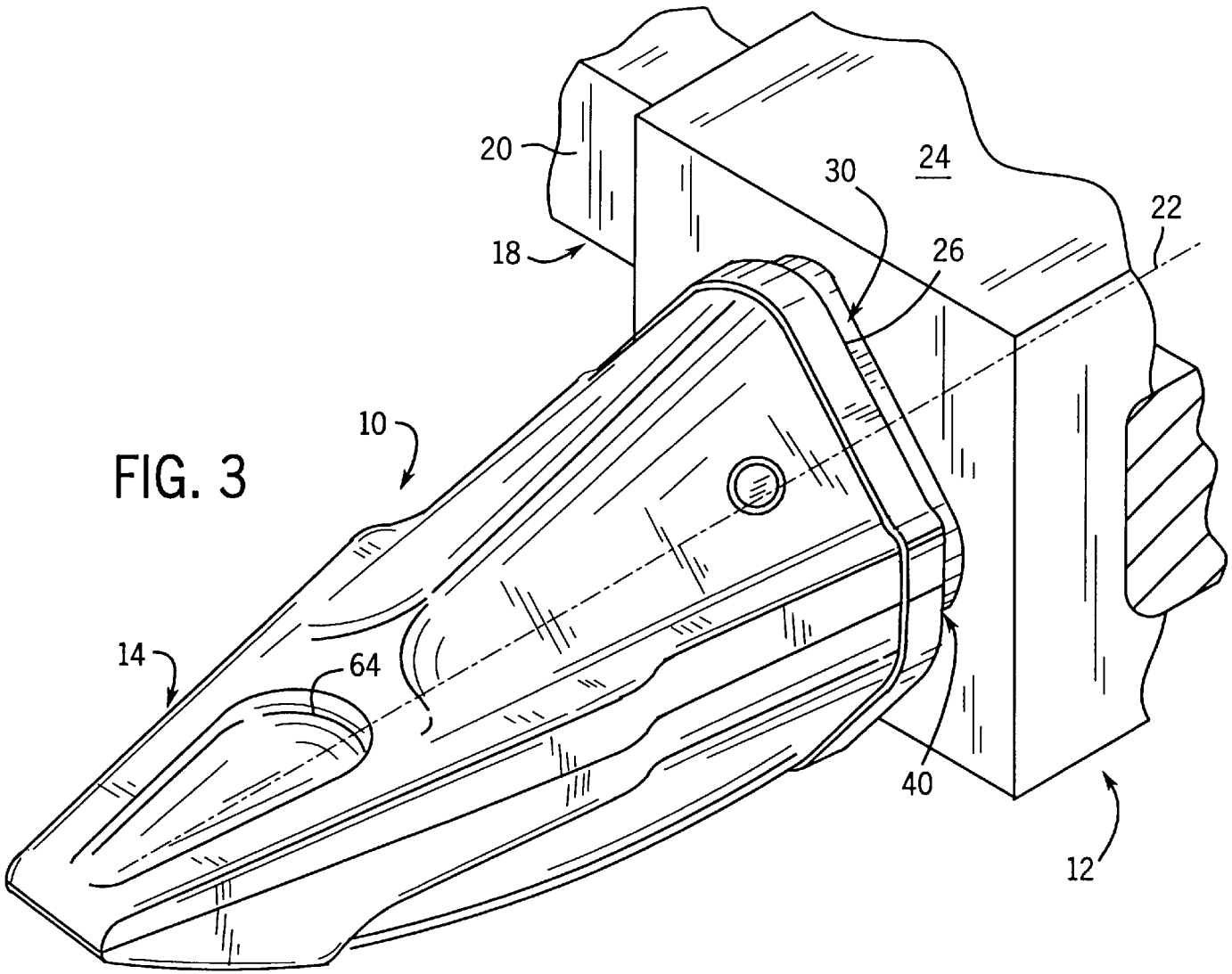
FIG. 3 is a perspective view of the excavating tooth assembly of the present invention.
Figure 4:
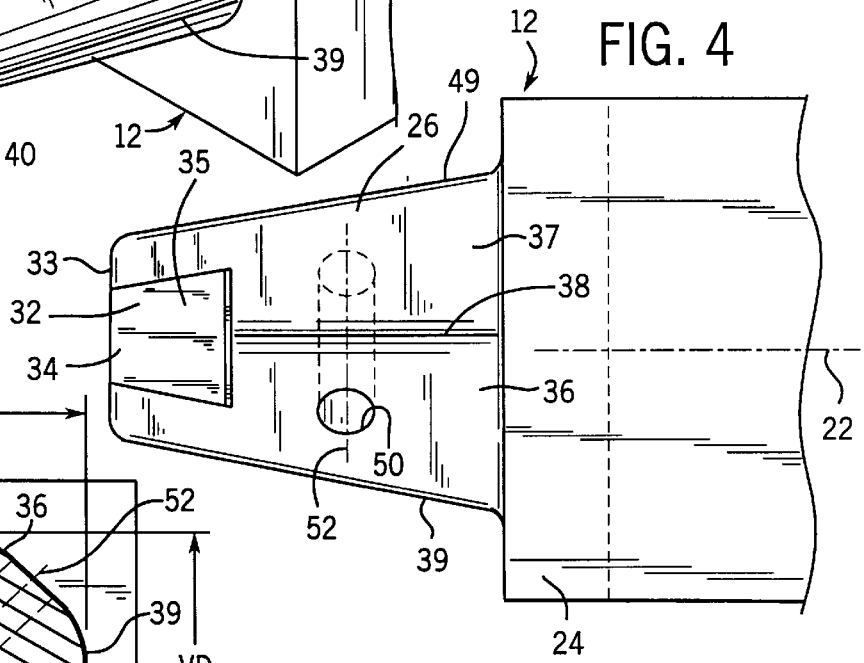
FIG. 4 is a top plan view of the adapter forming part of the excavating tooth assembly.
Figure 5:
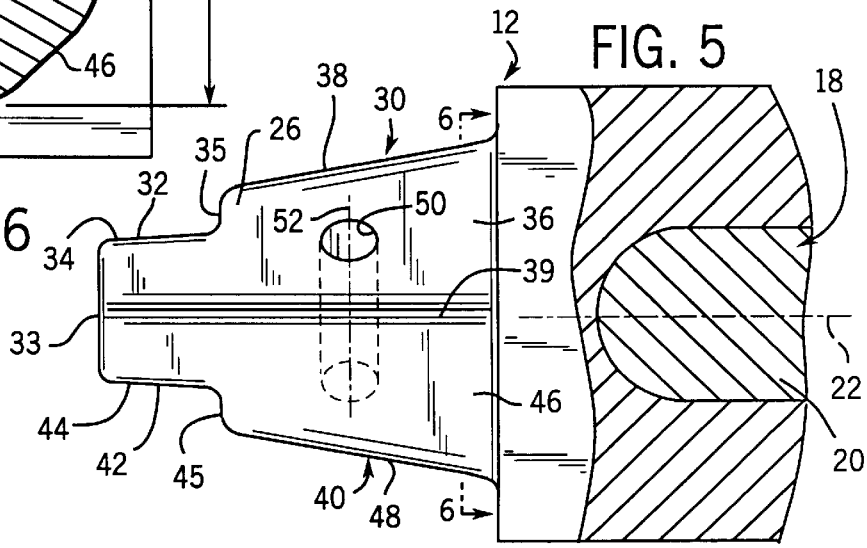
FIG. 5 is a side elevational view, partly in section, of the adapter illustrated in FIG. 4.
Figure 8:
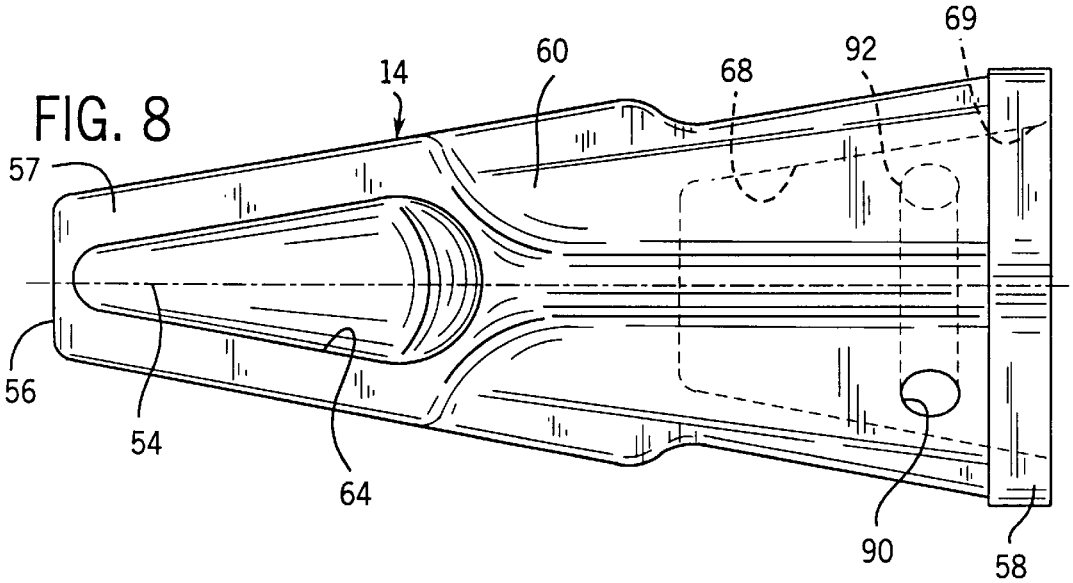
FIG. 8 is a top plan view of the excavating tooth forming part of the excavating tooth assembly of the present invention.

As shown in FIGS. 3, 4 and 5, the nose portion 26 of the adapter 12 has a forwardly tapered configuration including angularly converging top and bottom surfaces exterior surfaces 30 and 40, respectively. The top and bottom surfaces 30 and 40, respectively, are disposed generally above and below, respectively, the longitudinal centerline 22 of the adapter 12. In a preferred form of the invention, and as shown in FIGS. 4, 5 and 7, the exterior top and bottom surfaces 30, 40, respectively, of the adapter 12 are each provided with a recessed area 32, 42, respectively, arranged toward a terminal end region 33 of the adapter 12. Preferably, the recessed areas 32, 42 are equally disposed on the surfaces 30, 40 and relative to the longitudinal centerline 22 of the adapter 12. Each recessed area 32, 42 defines a stabilizing surface or land on the surfaces 30, 40 of the adapter 12.

Each land 32, 42 protrudes inwardly from the respective slanted surface 30, 40 on the adapter 12 to define a generally flat or horizontal surface 34, 44 extending generally parallel to the longitudinal centerline 22 of the adapter 12. As will be appreciated, a predetermined vertical distance is measurable between the flats or generally horizontal surfaces 34, 44 on the top and bottom surfaces 30, 40 of the adapter 12. Moreover, each land 32, 42 includes a generally vertical stabilizing wall 35, 45, respectively. As will be described below, the lands 32, 42 on the top and bottom surfaces 30 and 32, respectively, of the adapter 12 provide greater load distribution to absorb extreme vertical loads commonly imparted to the tooth assembly during an excavating operation while the vertical stabilizing walls 35, 45 on each stabilizing land 32, 42, respectively, provide additional vertical bearing surfaces to assist in absorbing extreme horizontal loads which are likewise commonly imparted to the tooth assembly during an excavating operation.

One of the salient feature of the present invention relates to a unique configuration of the nose portion 26 of the adapter 12. As shown in FIGS. 4, 6 and 7, the top surface 30 of the adapter 12 has two downwardly disposed and angled sides or facets 36 and 37 joined to each other along a common top edge 38 extending forwardly along the adapter 12 from the base portion 24. As shown, the angled sides or facets 36, 37 forming the top surface 30 of the adapter 12 are arranged on opposite lateral sides of the longitudinal centerline 22 of the adapter 12. The common top edge 38 joining the two sides 36, 37 extends for a major length of the adapter 12 and is generally centrally disposed along the longitudinal centerline 22 thereof In a preferred form of the invention, the angled sides 36, 37 forming the top surface 30 of the adapter 12 slant or slope longitudinally downward toward the free end of the nose portion 26 of the adapter 12.

In a preferred from of the invention, the downwardly disposed sides 36, 37 forming the top surface 30 of the adapter 12 each have a generally planar configuration. In this form of the invention, the sides 36, 37 forming the top surface of the adapter 12 are each slanted at an angle of about 45° relative to a horizontal plane and the common top edge 38 is formed at the intersection of those planes defined by and along the planar configurations of the angled sides 36, 37. In the preferred form of the invention, and as illustrated in FIG. 6, the common top edge 38 has a radiused or curved configuration.

In a preferred form of the invention, and as best shown in FIG. 6, the bottom surface 40 of the adapter 12 has a complementary configuration relative to the top surface 30. That is, the bottom or lower surface 40 of the adapter 12 has two upwardly disposed and angled sides or facets 46 and 47 joined to each other along a common bottom or lower edge 48 and extending forwardly along the adapter 12 from the base portion 24. As shown, the angled sides or facets 46, 47 forming the bottom surface 40 of the adapter 12 are arranged on opposite lateral sides of the longitudinal centerline 22 of the adapter 12. The common lower or bottom edge 48 joining the two angled sides 46, 47 extends for a major length of the adapter 12 and is generally centrally disposed along the longitudinal centerline 22 thereof In a preferred form of the invention, the sides 46, 47 of the bottom surface 40 slant or slope longitudinally downward toward the free end of the nose portion 26 of the adapter 12.

In a preferred form of the invention, the sides 46, 47 forming the bottom or lower surface 40 of the adapter 12 each has a generally planar configuration. In this form of the invention, the sides 46, 47 forming the top surface of the adapter 12 are each slanted at an angle of about 45° relative to a horizontal plane and the common top edge 48 is formed at the intersection of those planes defined by and along the planar configurations of the angled sides 46, 47. In the preferred form of the invention, and as illustrated in FIG. 6, the common top edge 38 has a radiused or curved configuration.

In that embodiment of the invention wherein the sides 36, 37 forming the top surface 30 and the sides 46, 47 forming the lower or bottom surface 40 of the adapter 12 are configured with generally planar configurations, as shown in FIG. 6, the nose portion 26 of the adapter 12 is provided with a generally rectangular or quadrilaterally shaped like cross-sectional configuration for a major lengthwise longitudinal distance thereof. In a most preferred form of the invention, the four-sided nose portion 26 of the adapter 12 has a cross-sectional configuration of an equilateral parallelogram. Because the sides 36, 37 and 46, 47 of the top and bottom surfaces 30 and 40, respectively, converge toward the terminal end of the adapter 12, the rectangular or quadrilaterally shaped cross-sectional configuration of the nose portion 26 of the adapter 12 increases as a function of the distance measured rearwardly from the free terminal end 33 thereof. Notably, however, the nose portion 26 of the adapter 12 preferably maintains an equilateral parallelogram cross-sectional configuration between the sides 36, 37 and 46, 47 thereof for the length thereof.

In this embodiment of the invention, the angularly disposed sides 36 and 46 forming the top and bottom surfaces 30 and 40, respectively, which are disposed to one side of the longitudinal centerline 22 of the adapter 12, are likewise joined to each other along a common side edge 39 extending longitudinally forward from the base portion 24 of the adapter 12. The common side edge 39 is formed at the intersection of those planes defined by and along the planar configurations of the angled sides 36, 46. In the preferred form of the invention, and as illustrated in FIG. 6, the common side edge 39 has a radiused or curved configuration. Similarly, with the embodiment of the invention illustrated in FIG. 6, the angularly disposed sides 37 and 47 of the top and bottom surfaces 30 and 40, respectively, arranged on an opposite side of the longitudinal axis 22 of the adapter 12 are joined to each other along a common side edge 49 extending longitudinally forward from the base portion 24 of the adapter 12. The common side edge 49 is formed at the intersection of those planes defined by and along the planar configurations of the angled sides 37,47. In the preferred form of the invention, and as illustrated in FIG. 6, the common side edge 49 has a radiused or curved configuration. As will be appreciated, the quadrilateral cross-sectional configuration of the nose portion 26 of the adapter 12 provides any two sides 36, 37 and 46, 47 of the top and bottom surfaces 30, 40, respectively, of the adapter 12 to be joined along a common edge.

In the embodiment of the invention illustrated in FIG. 6, a major lengthwise section of the nose portion 26 of the adapter 12 is offset at an angle of about 45° relative to the base portion 24 of the adapter 12. As such, the vertical distance VD measurable across the adapter 12 and between the common top and bottom edges 38 and 48 on the top and bottom surfaces 30 and 40, respectively, is significantly greater than the distance measurable across either of the two opposed sides on the top and bottom surfaces 30, 40, respectively, of the adapter 12. Similarly, the horizontal distance HD measurable across the adapter 12 and between the common side edges 39 and 49 on the top and bottom surfaces 30 and 40, respectively is significantly greater than the distance measurable across either of the two opposed sides on the top and bottom surfaces 30 and 40, respectively, of the adapter 12.

The nose portion 26 of the adapter 12 further defines a recess or aperture 50 for accommodating the pin retaining apparatus 16. In the embodiment of the invention illustrated in FIGS. 1 through 7, the recess or bore 50 extends through the adapter 12 and has opposed open ends. As illustrated in FIG. 6, the bore or recess 50 is disposed along an axis 52 which intersects opposite sides 36, 47 of the top and bottom surfaces 30 and 40, respectively, disposed on opposite lateral sides of the longitudinal axis of the adapter 12. In the illustrated embodiment, the axis 52 of the recess or bore 50 is disposed at an angle of about 45° relative to a horizontal plane. In a most preferred form of the invention, and to facilitate fabrication of the adapter 12, the axis 52 of the recess or bore 50 extends generally normal to at least one of the sides forming the top and bottom surfaces 30, 40 of the adapter 12. As will be appreciated by those skilled in the art, the bore 50 will be sized and configured to accommodate the elongated fastener 16 serving to releasably hold the adapter 12 and excavating tooth 14 in operable combination relative to each other.

Figure 9:
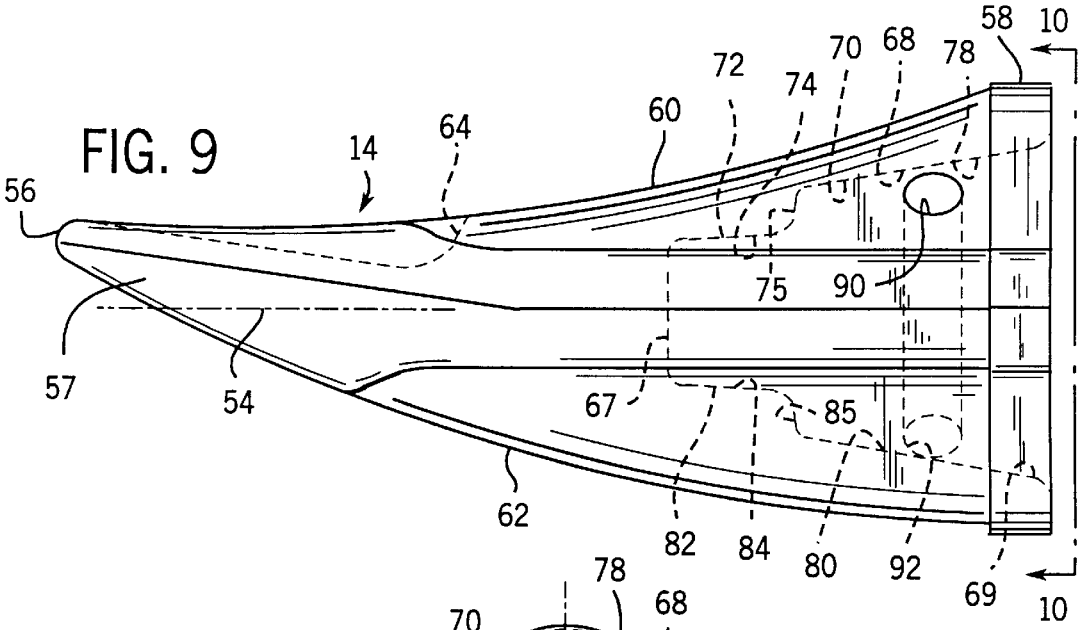
FIG. 9 is a side elevational view of the excavating tooth illustrated in FIG. 8.
Figure 10:
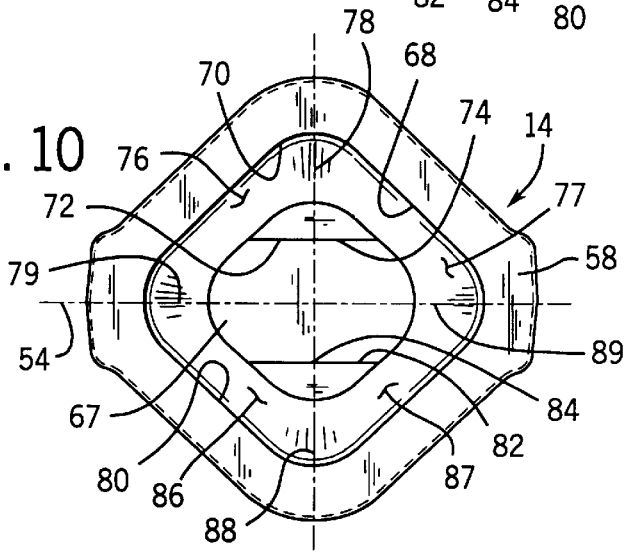
FIG. 10 is a rear view of the excavating tooth illustrated in FIG. 8.
Figure 11:
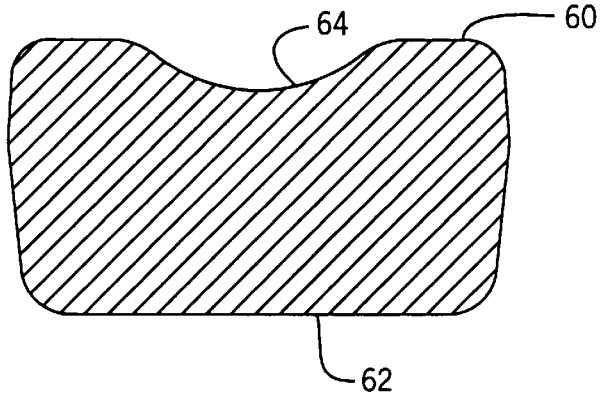
FIG. 11 is a sectional view taken along line 11—11 of FIG. 1.
Figure 12:
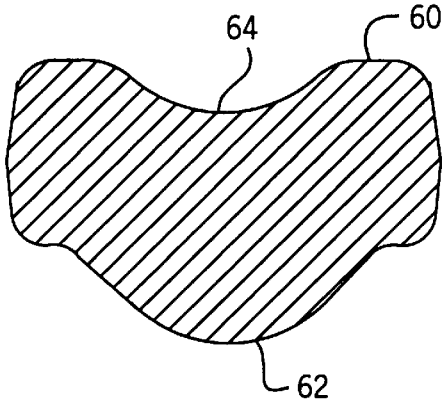
FIG. 12 is a sectional view taken along line 12—12 of FIG. 1.
Figure 13:
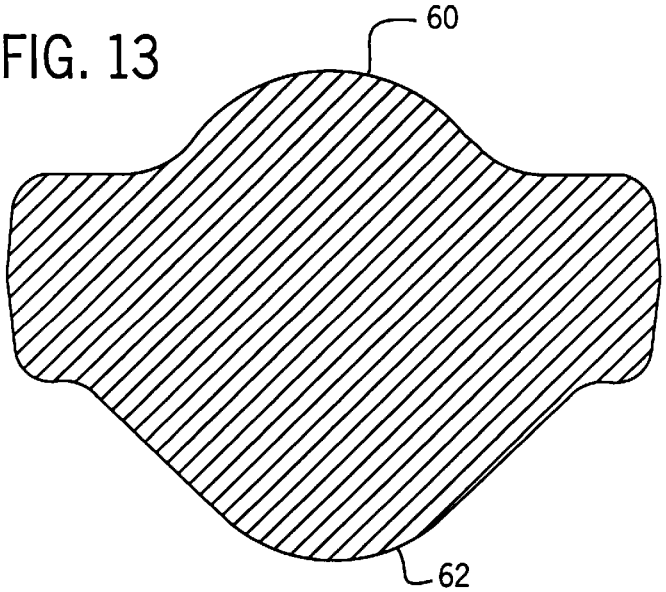
FIG. 13 is a sectional view taken along line 13—13 of FIG. 1.
Figure 14:
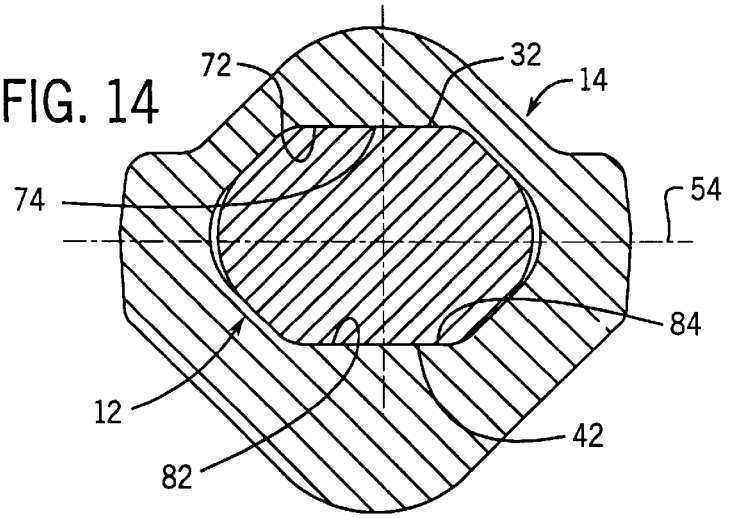
FIG. 14 is a sectional view taken along line 14—14 of FIG. 1.
Figure 15:
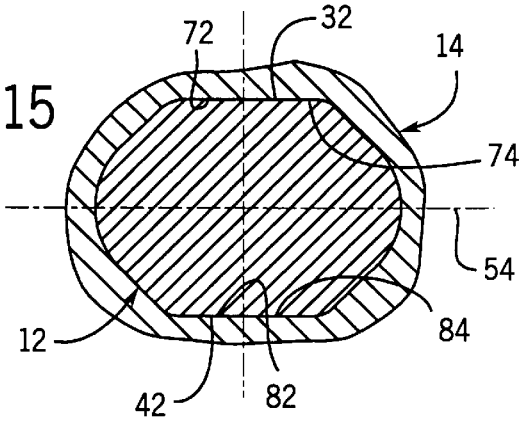
FIG. 15 is a sectional view taken along line 15—15 of FIG. 1.

When the multi-piece excavating tooth 10 is assembled, the excavating tooth 14 is configured for endwise accommodation along and about a lengthwise section of the nose portion 26 of the adapter 12. As shown in FIGS. 1, 2, 8 and 9, the excavating tooth 14 has an elongated wedge-like configuration defining a centerline 54 with a lateral cutting or ground penetrating edge 56 extending transversely across a forward end portion 57 and provided with a hollow rear mounting end 58. When assembled to the adapter 12, the cutting or ground penetrating edge 56 extends generally horizontal and, thus, generally parallel with the edge or lip 20 (FIG. 1) of the excavating equipment to which it is operably connected. As will be appreciated by those skilled in the art, the hollow mounting end portion 58 allows the tooth 14 to be fitted endwise onto the adapter 12. In a preferred form of the invention, the tooth 14 is formed as a result of a forging operation, thus, enhancing the strength and rigidity thereof As shown, the tooth 14 includes upper and lower exterior surfaces 60 and 62, respectively, extending rearwardly from the forward cutting edge 56 and extending toward the rear end 59 of the tooth 14. As the surfaces 60, 62 extend rearwardly from the edge 56, they angularly diverge away from each other. As shown in FIGS. 8, 9, 11 and 12, the top or upper exterior surface 60 of the tooth 14 is configured with a specifically configured recess 64 extending rearwardly from the lateral edge 56 (FIG. 1) for inhibiting blunting of the tooth 14 as a result of wear thereto. As shown in FIG. 13, the cross-sectional configuration of the tooth 14, and the top surface 60 thereof, significantly changes as a function of the distance measured rearwardly from the cutting edge 56 (FIG. 1) thereof As is conventional in multi-piece tooth assemblies of the type hereunder consideration, and as shown in FIG. 10, the rear portion 58 of the tooth 14 defines a blind cavity or socket 68 opening to the rear end of the tooth 14. In a preferred form of the invention, and as shown in FIG. 9, the edge of the cavity 68 opening to rear end 58 has an inwardly directed radius 69 extending thereabout to facilitate and guide endwise insertion of the nose portion 26 of the adapter 12 into a mating conjunctive relationship or fit with the tooth 14.

As illustrated in FIGS. 9 and 10, the cavity 68 defined by the tooth 14 includes top and bottom interior surfaces 70 and 80, respectively, extending forwardly from the open rear end of the cavity 68 toward the forward edge 56 of the tooth 14 and angularly converge toward each other at substantially the same angle the top and bottom surfaces 30 and 40, respectively, are disposed on the nose portion 26 of the adapter 12. The top and bottom interior surfaces 70, 80 terminate in an end wall 67. The top and bottom surfaces 70 and 80, respectively, are disposed generally above and below, respectively, the longitudinal centerline 54 of the tooth 14. In a preferred form of the invention, the interior top and bottom surfaces 70 and 80, respectively, defined by cavity or socket 68 of tooth 14 furthermore include a pair of stabilizing lands 72 and 82, respectively, arranged toward and extending rearwardly from the terminal end wall 67 of the cavity 68. The stabilizing lands 72, 82 are disposed and configured to mate with the lands 32, 42, respectively, on the nose portion 26 when the adapter 12 and tooth 14 are arranged in operable combination relative to each other.

As illustrated in FIGS. 9, 10, 14 and 15, each stabilizing land 72, 82 protrudes inwardly from the top and bottom surface 70, 80, respectively, toward the centerline 54 of the tooth 14 to define generally flat or horizontal surfaces 74, 84 extending generally parallel to the centerline 54 of the tooth 14. As will be appreciated, a predetermined vertical distance is measurable between the flat or generally horizontal surfaces 74, 84 on the top and bottom surfaces 70, 80, respectively, of cavity 68 defined by tooth 14. Moreover, each stabilizing land 72, 82 includes a generally vertical stabiling wall 75, 85, respectively.

As will be appreciated from an understanding of this aspect of the present invention, the lands 72, 82 on the tooth 14 combine with the lands 32, 42 on the nose portion 26 of the adapter 12 to absorb and distribute extreme vertical loads commonly imparted to the tooth assembly 10 during an excavating operation. Moreover, the stabilizing walls 75, 85 on the top and bottom surfaces 70, 80, respectively, of the cavity 68 defined by tooth 14 operably combine with the stabilizing walls 35, 45 (FIG. 5) on the adapter 12 to provide additional bearing surfaces to assist in distributing an absorbing extreme horizontal loads commonly imparted to the tooth assembly 10 during normal excavating operations.

As will be appreciated by those skilled in the art, the cavity 68 defined by tooth 14 is configured to accommodate a major lengthwise section of the nose portion 26 of adapter 12. In a preferred form, the cavity 68 defined by tooth 14 has a quadrilateral cross-sectional configuration. As shown in FIG. 10, the top surface 70 defining a portion of cavity 68 has two downwardly disposed sides 76 and 77 joined to each other along a common top edge 78 extending forwardly from the open end of the cavity 68. As shown, the angled sides 76, 77 defining the top surface 70 of cavity 68 are arranged on opposite lateral sides of the longitudinal centerline 54 of the tooth 14. The common top edge 78 joining the two sides 76, 77 of the top surface 70 of cavity 68 extends for a major length of the cavity 68 and is generally centrally disposed relative to the longitudinal centerline 54 of tooth 14. In a preferred form of the invention, the sides 76 and 77 defining the top surface 70 of the cavity longitudinally slope or slant downwardly toward the terminal wall 67 of cavity 68.

In a preferred form of the present invention, the sides 76, 77 forming the top surface 70 of cavity 68 defined by tooth 14 each have a generally planar configuration. In this form of the invention, the sides 76, 77 forming the top surface 70 of cavity 68 are each slanted at an angle of about 45° relative to the forward cutting edge 56 of the tooth 14 and the common top edge 78 is formed at the intersection of those planes defined by and along the planar configurations of the angled sides 76,77 forming the top surface 70 of the cavity 68. In the preferred form of the invention, and as illustrated in FIG. 6, the common top edge 78 has a radiused or curved configuration.

In that embodiment of the invention illustrated in FIG. 10, the bottom surface 80 forming part of cavity 68 as a complementary configuration relative to the top surface 70 of cavity 68 defined by tooth 14. That is, the bottom or lower surface 80 forming cavity 68 has two upwardly disposed sides 86 and 87 joined to each other along a common bottom edge 88 extending forwardly from the open end of the cavity 68 defined by tooth 14. As shown, the angled sides 86, 87 forming the bottom or lower surface 80 of cavity 68 are arranged on opposite lateral sides of the longitudinal centerline 54 of the tooth 14. The lower or bottom common edge 88 joining the sides 86 and 87 of cavity 68 extends for a major length of the cavity and is generally centrally disposed relative to the longitudinal centerline 54 of the tooth 14.

In a preferred form of the present invention, the sides 86, 87 forming the bottom or lower surface 80 of cavity 68 defined by tooth 14 each have a generally planar configuration. In this form of the invention, the sides 86, 87, forming the top surface 80 of cavity 68, are each slanted at an angle of about 45° relative to the forward cutting edge 56 of the tooth 14 and the common bottom edge 88 is formed at the intersection of those planes defined by and along the planar configurations of the angled sides 86,87 forming the bottom surface 80 of the cavity 68. In the preferred form of the invention, and as illustrated in FIG. 6, the common bottom edge 88 has a radiused or curved configuration.

In that embodiment of the invention wherein the sides 76, 77 forming the top surface 70 of cavity 68 and the sides 86, 87 forming the lower or bottom surface 80 of the cavity 68 are configured with generally planar surfaces, as shown in FIG. 10, the cavity 68 is provided with a generally rectangular or quadrilateral cross-sectional configuration along a major lengthwise portion thereof. In a most preferred form of the invention, the four sided cavity 68 defined by the tooth 14 has a cross-sectional configuration of an equilateral parallelogram. Because the sides 76, 77 of the top surface 70 and the sides 86, 87 forming the bottom surface 80 of cavity 68 each slope toward the terminal wall 67, the cross-sectional configuration of the cavity 68 decreases in area as measured forwardly from the rear open end 58 thereof. Notably, however, and for a major lengthwise distance thereof, the cavity 68 defined by tooth 14 preferably maintains an equilateral parallelogram cross-sectional configuration between the sides 76, 77 and 86, 87 thereof. Moreover, and as shown in that embodiment of the invention illustrated in FIG. 10, the cavity 68 is offset relative to the forward cutting or penetrating edge at an angle of about 45°.

In the embodiment of the invention illustrated in FIG. 10, the angularly disposed sides 76 and 86 partially forming the top and bottom surfaces 70 and 80, respectively, of cavity 68 and which are disposed to one side of the longitudinal centerline 54 of tooth 14 are likewise joined to each other along a common side edge 79 extending longitudinally forward from the open end of the cavity 68 defined by tooth 14. The common side edge 79 is formed at the intersection of those planes defined by and along the planar configurations of the angled sides 76 and 86 of the cavity 68. In the illustrated form of the invention, and as illustrated in FIG. 10, the common side edge 79 has a radiused or curved configuration. Similarly, with the embodiment illustrated in FIG. 10, the angularly disposed sides 77 and 87 partially forming the top and bottom surfaces 70 and 80, respectively, of cavity 68 and which are disposed to an opposite side of the longitudinal centerline 54 of tooth 14 are joined to each other along a common side edge 89 extending longitudinally forward from the open end of the cavity 68 defined by tooth 14. The common side edge 89 is formed at the intersection of those planes defined by and along the planar configurations of the angled sides 77, 87 of the cavity 68. In the preferred form of the invention, and as illustrated in FIG. 10, the common side edge 89 has a radiused configuration. As will be appreciated, the quadrilateral cross-sectional configuration of the cavity 68 provides any two sides 76, 77 and 86, 87 of the top and bottom surfaces 70 and 80, respectively, of the cavity 68 defined by tooth 14 to be joined along a common edge.

Figure 16:
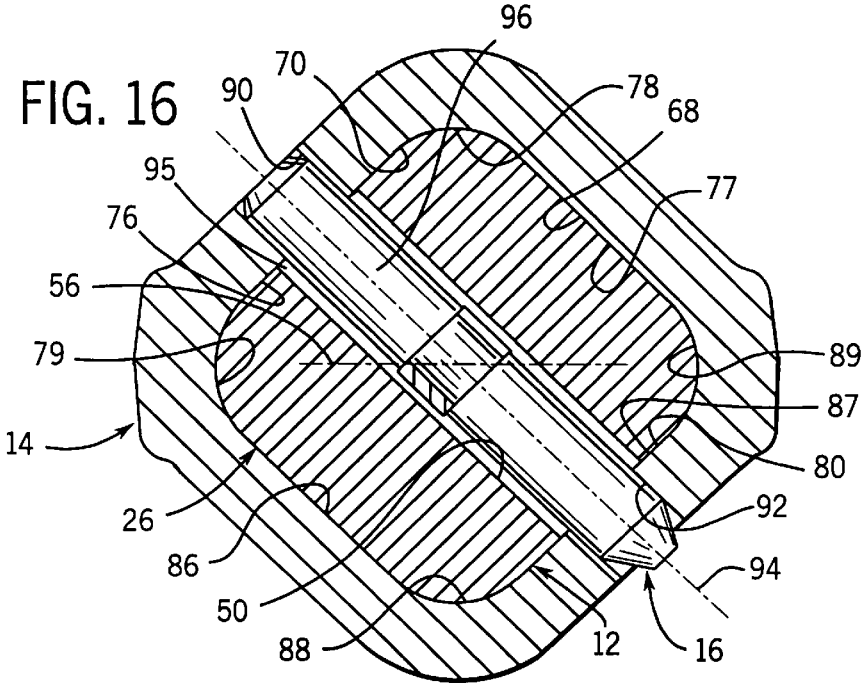
FIG. 16 is a sectional view taken along line 16—16 of FIG. 1.
Figure 17:
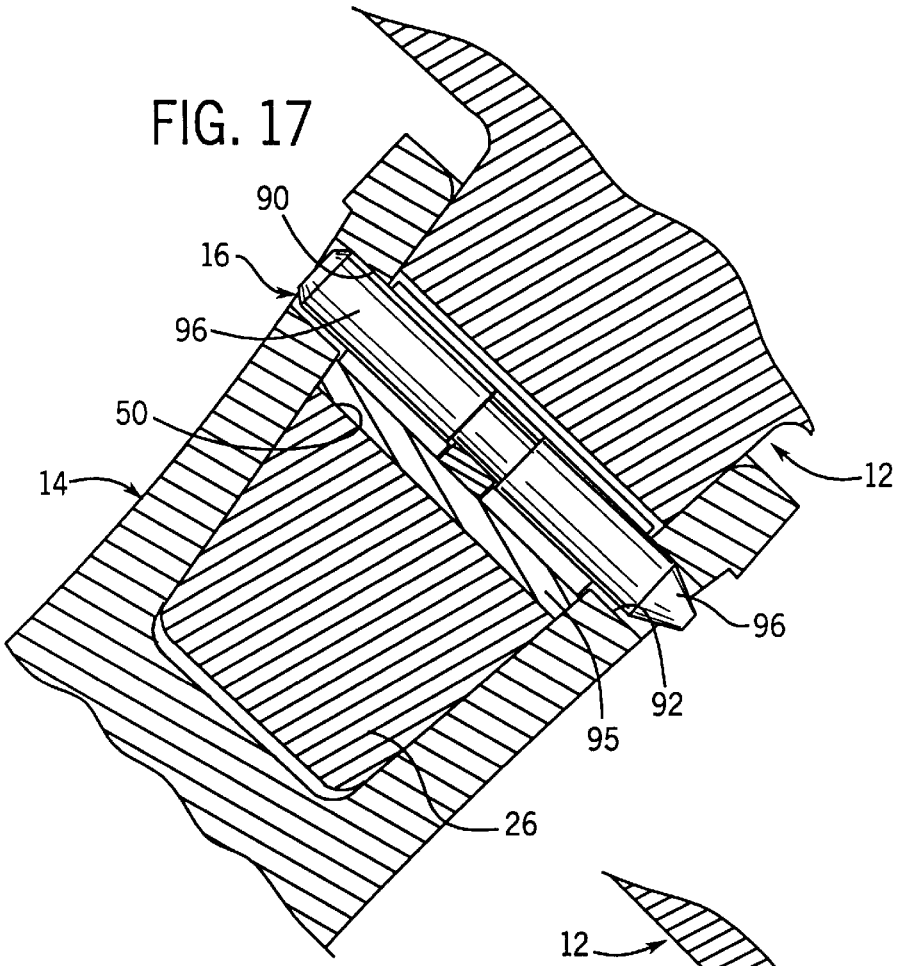
FIG. 17 is a sectional view taken along line 17—17 of FIG. 1.

To coact with the adapter 12, the excavating or digging tooth 14 is furthermore recessed to accommodate a lengthwise portion of the retainer pin apparatus 16. In the embodiment illustrated in FIGS. 8, 9, 16 and 17, the recessed tooth 14 defines a pair of axially aligned throughholes or openings 90 and 92. As illustrated in FIG. 16, the holes 90, 92 are aligned about an axis 94 which intersects diametrically opposed sides 76 and 87 of the top and bottom surfaces 70 and 80 and passes through the cavity 68 defined by tooth 14. In the illustrated form of the invention, the axis 94 defined by holes 90, 92 of tooth 14 is disposed at an angle of about 45° relative to the ground engaging or penetrating edge 56 of the tooth 14. The holes or openings 90, 92 in the tooth 14 are configured to accommodate endwise passage of the pin retaining apparatus or fastener 16 therethrough thus permitting the adapter 12 and tooth 14 to be releasably interconnected in operable relationship relative to each other. As will be appreciated by, and as known to those skilled in the art, the fore-and-aft relationship of the holes 90, 92 in the tooth 14 and the bore 50 in the nose portion 26 of the adapter 12 are arranged such that the fastener 16 is maintained in locked relationship relative to the adapter 12 and tooth 14 so as to inhibit inadvertent endwise displacement thereof The retainer pin structure or apparatus 16 for releasably interconnecting and maintaining the adapter 12 and tooth 14 in operable combination relative to each other can take a myriad of different forms without detracting or departing from the spirt and scope of the present invention. In one form, the retainer pin structure 16 can be of the type disclosed in coassigned U.S. Pat. No. 5,765,301 granted Jun. 16, 1998; the full disclosure of which is incorporated herein by reference. Suffice it to say, in the embodiment illustrated in FIGS. 16 and 17, the retainer pin apparatus 16 passes endwise through the bore 50 defined in the nose portion 26 of the adapter 12 and extends, at least partially, endwise into each of the holes or openings 90, 92 defined by tooth 14 thereby securing the adapter 12 and tooth 14 in operable combination relative to each other. The retainer pin structure 16 illustrated in FIGS. 16 and 17 includes an elongated, hollow rigid sleeve 95 accommodated within bore 50 of the nose portion 26 of the adapter 12 and an elongated pin 96 snuggly yet slidably fitted within and extending axially beyond opposite ends of the sleeve 94 for engaging the aligned holes or opening 90, 92 in the tooth 14 thereby releasably interconnecting and maintaining the adapter 12 and tooth 14 in operable combination relative to each other.

Figure 18:
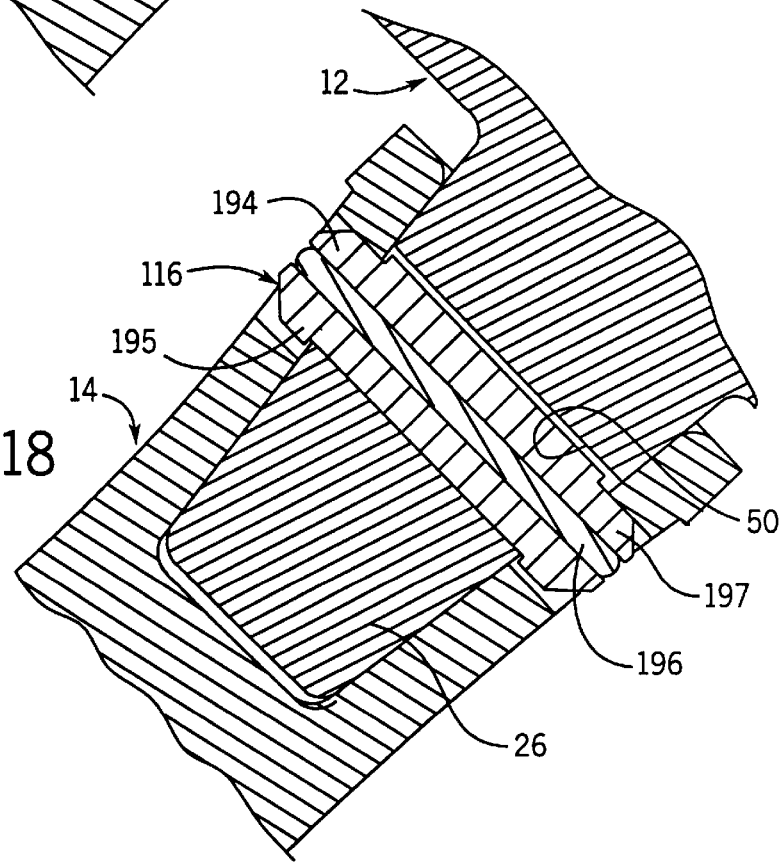
FIG. 18 is a view similar to FIG. 17 but showing an alternative cross-sectional configuration for a retainer pin assembly for releasably holding the adapter and digging or excavating tooth in operable combination relative to each other.

Another embodiment of a retainer pin structure or fastener 16 for holding and maintaining the adapter 12 and tooth in operable combination relative to each other is illustrated in FIG. 18. This alternative form of retainer pin structure is designated generally by reference numeral 116. The elements of this alternative form of fastener that are identical or functionally analogous to those components of the retainer pin structure or fastener 16 discussed above are designated by reference numerals identical to those used above with the exception that this embodiment of the fastener 116 uses reference numerals in the one-hundred series.

In this form, the fastener 116 is of a conventional design and includes an elongated pin assembly 194 passing through and extending axially beyond the bore 50 in the nose portion 26 of the adapter 12. As is known in the art, the pin assembly 194 typically includes a pair of pin halves 195 and 197 that are bonded and otherwise sandwich a resilient elastomeric member 196 therebetween. The pin halves 195 and 197 are appropriately configured along their lengths thereof to normally maintain the pin assembly 194 against endwise displacement during an excavating operation.

Figure 19:
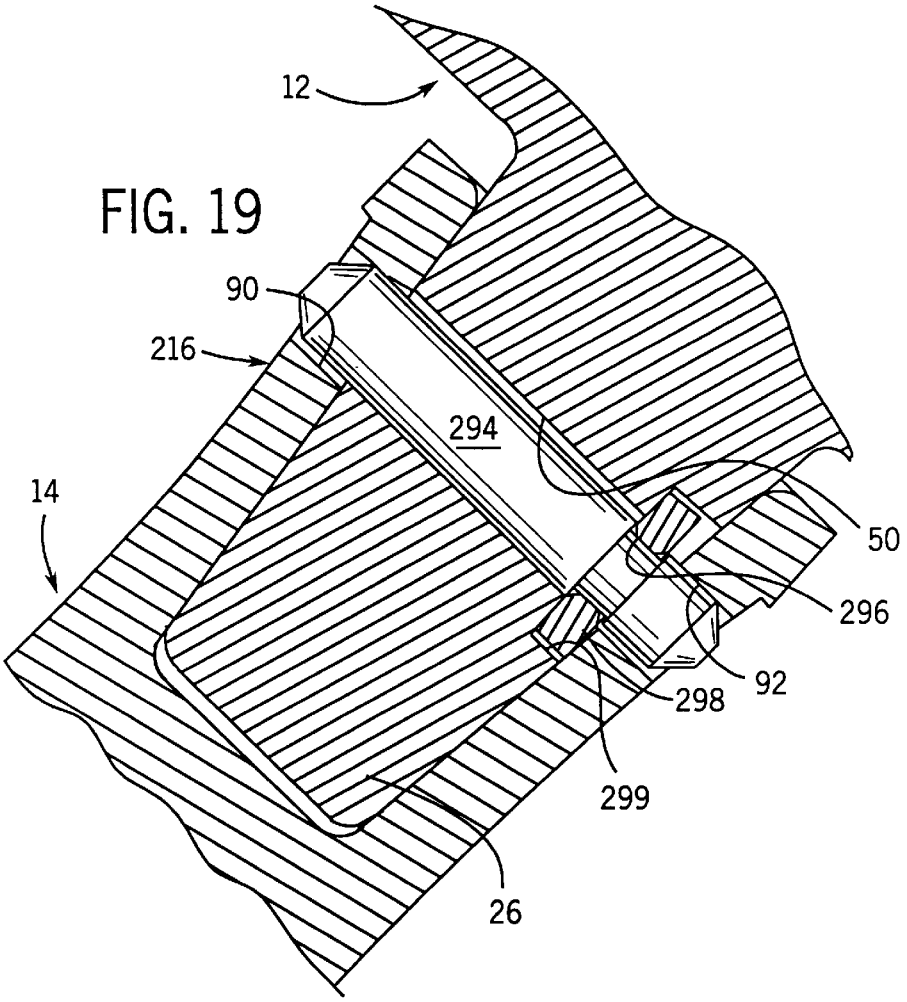
FIG. 19 is a view similar to FIG. 17 but illustrating in cross section another alternative configuration of a retainer pin assembly for releasably holding the excavating tooth and adapter in releasable but operable combination relative to each other.

Still another embodiment of a fastener for holding and maintaining the adapter 12 and tooth in operable combination relative to each other is illustrated in FIG. 19. This alternative form of fastener is designated generally by reference numeral 216. The elements of this alternative form of fastener that are identical or functionally analogous to those components of the fastener 16 discussed above are designated by reference numerals identical to those used above with the exception that this embodiment of the fastener 216 uses reference numerals in the two-hundred series.

In this form, the fastener 216 is of a conventional design and includes an elongated pin 294 passing through and an endwise extending beyond the bore 50 defined in the nose portion 26 of the adapter 12. Notably, the opposite free ends of pin 294 pass at least partially through and engage the perimeter of the axially aligned holes or openings 90, 92 defined by tooth 14. In this form, the fastener 216 further includes a resilient snap ring 298 preferably carried within a suitably shaped recess 299 defined by the nose portion 26 of the adapter 12 preferably toward the lower end of and in generally concentric relationship relative to the bore 50. As will be appreciated by those skilled in the art, as the elongated pin 294 is forced therethrough, the ring 298 will radially expand when the pin 294 is axially forced therethrough. After a lenghtwise portion of the retainer pin 294 extends through the ring 298, an annular groove 296 on the pin 294 again permits contraction of the ring 298 about the pin and into the groove 296 thereby normally inhibiting the pin 294 from endwise movement relative to the adapter 12 and tooth 14.

Yet another alternative form of retainer pin structure for releasably holding and maintaining the adapter and tooth of the multi-piece tooth assembly in operable combination relative to each other is illustrated in FIG. 20. This alternative form of retainer pin structure or fastener is designated generally by reference numeral 316. The elements of this alternative form of fastener that are identical or functionally analogous to those components of the fastener 16 discussed above are designated by reference numerals identical to those used above with the exception that this embodiment of the fastener 316 uses reference numerals in the three-hundred series.

In this form, the retainer pin structure 316 is of conventional design and includes an elongated pin 394 passing transversely across and in operable engagement with a raised ridge or top edge 38 on the top surface 30 of the nose portion 26 of adapter 12. In this form of the invention, the excavating tooth 14 is provided with a pair of axially aligned holes or opening 390 and 392 disposed on opposite sides of the upper surface 60 thereof Moreover, in this form of the invention, and as shown in FIG. 21, the top edge 38 on the nose portion 26 of the adapter 12 is provided with a transversely extending open top channel or recess 350. Notably, the recess or channel 350 defines an axis 351 extending transversely across and generally normal to the longitudinal axis 322 of the adapter 12. As shown, opposite ends of the channel 350 open to opposite sides 36, 37 of the top surface 30 and on opposite lateral sides of the centerline of the adapter. As will be appreciated, channel 350 is axially positioned along the length of the nose portion 26 of the adapter 12 so as to coact with the axially aligned openings 390, 392 (FIG. 20) on the tooth 14 in holding the tooth and the adapter in releasable combination relative to each other after the retainer pin structure 316 is inserted through each.

As will be appreciated, both the axially aligned holes 390, 392 on the tooth 14 and the channel 350 on the adapter 12 are sized to snuggly accommodate the pin 394 of retainer pin structure 316. In a manner known in the art, the fastener pin 394 preferably has an elongated split configuration with a natural resilient bias tending to force the pin 394 to naturally expand radially outwardly while allowing for radial contraction of the pin 394 to allow it to slidably fit through the holes 390, 392 and channel 350. After the tooth is assembled to the adapter, the holes 390, 392 align with the channel 350 thereby allowing the retainer pin 394 to pass endwise therethrough. As will be appreciated, after the pin 394 is passed therethrough, a lengthwise portion of the pin 394 engages the channel 350 thereby inhibiting endwise movement of the tooth relative to the adapter. In this embodiment of the invention, the channel 350 extends only through a limited area of the adapter 12 thereby adding strength to the nose portion 26 of the adapter 12.

Another alternative form of retainer pin structure for releasably holding and maintaining the adapter and tooth of the multi-piece tooth assembly in operable combination relative to each other is illustrated in FIG. 22. This alternative form of retainer pin structure or fastener is designated generally by reference numeral 416. The elements of this alternative form of retainer pin structure that are identical or functionally analogous to those components of the retainer pin structure 16 discussed above are designated by reference numerals identical to those used above with the exception that this embodiment of the fastener 416 uses reference numerals in the four-hundred series.

In this form, the retainer pin structure 416 includes a stub fastener 494 passing through an opening 490 defined on one side of the digging or excavating tooth 14 and accommodated within a blind recess or opening 450 defined on a side 436 of the top surface 430 of the adapter 12. The stub fastener 494 includes a pair of halves 495 and 497 resiliently joined to each other by an elastomeric member 499 which is bonded to confronting surfaces on the pin halves 495 and 497. In a preferred form, the pin halves 495 and 497 are disposed in a fore-and-aft relationship relative to each other such that when the multi-piece excavating tooth assembly is assembled the pin structure 416 serves to bias the tooth 14 lengthwise onto the nose portion 26 of the adapter 12.

As shown in FIG. 23, the blind recess 450 is configured to accommodate the free end of the stub fastener 494. As illustrated, the blind recess or opening 450 opens to the side 436 of the top surface 430 of the adapter 12 and is disposed along an axis 452 extending generally normal to the generally planar side 436 of the top surface 430 of the adapter 12. As will be appreciated, the recess 450 is axially disposed in predetermined relation relative to the opening 490 in the tooth 12 after the components of the multi-piece tooth assembly are connected to each other. After the retainer pin structure 416 passes through the opening 490 in the tooth 12, a lengthwise portion of the retainer pin structure 416 is accommodated within the recess 450 thereby inhibiting endwise movement of the tooth 12 and adapter 14 relative to each other. Moreover, and because with this embodiment, the recess 450 extends only partially through a limited area of the adapter 12, the nose portion 26 of the adapter 12 is provided with extra strength and rigidity .

Still another alternative form of retainer pin structure for releasably holding and maintaining the adapter and tooth of the multi-piece tooth assembly in operable combination relative to each other is illustrated in FIG. 24. This alternative form of retainer pin structure or fastener is designated generally by reference numeral 516. The elements of this alternative form of retainer pin structure that are identical or functionally analogous to those components of the retainer pin structure 16 discussed above are designated by reference numerals identical to those used above with the exception that this embodiment of the fastener 516 uses reference numerals in the five-hundred series.

In this form, the retainer pin structure 516 is substantially similar to that disclosed in U.S. Pat. No. 4,611,418 granted on Sep. 16, 1986; the full disclosure of which is incorporated herein by reference. Suffice it to say, and as shown in FIGS. 24 and 25, the retainer pin structure 516 includes a resiliently biased detent 594. As illustrated in FIG. 24, the detent 594 is accommodated within a recess or opening 550 defined on the nose portion 26 of the adapter 12. A recess or opening 590 is cooperatively arranged on the digging tooth 12 for accommodating the free end of the detent 594. As shown, the hole or recess 550 for accommodating the retainer pin structure 516 defines an axis 552 disposed generally normal to the planar configuration of a side on one of either the top or bottom surfaces of the nose portion 26 of the adapter.

As shown in FIG. 24, a plurality of detents can be arranged in cooperative relationship relative to each other. When a plurality of retainer pin structures 516, similar to that disclosed in FIGS. 24 and 25, are arranged in cooperative relationship relative to each other to releasably fasten the tooth and adapter in operable combination relative to each other, the axial disposition of the detents 594 may require axial spacing along the length of the nose portion 26 of the adapter 12. As will be appreciated by those skilled in the art, a curved surface at the leading edge of the blind cavity 68 defined by the tooth 14 will facilitate compression of the resilient fastener 594 during assembly of the tooth and adapter.

FIG. 26 illustrates another form for the adapter 12 which embodies features of the present invention. This alternative form of adapter is designated generally by reference numeral 612. The elements of this alternative form of the adapter that are identical or finctionally analogous to those components discussed above regarding adapter 12 are designated by reference numerals identical to those used above with the exception that this embodiment used reference numerals in the six-hundred series.

In this embodiment of the invention, the adapter 612 includes a base portion 624 and a nose portion 626 in axially aligned relationship relative to each other and defines a centerline 622. Like adapter 12, adapter 612 is preferably fabricated from a forging operation to extend the durability and, thus, life of the adapter 612. As discussed above, the nose portion 626 of adapter 612 has an axially elongated tapered configuration with top and bottom surfaces 630 and 640, respectively, sloping or slanting and converging toward a free end of the nose portion 626. As shown, the top and bottom surfaces 630 and 640, respectively, are disposed above and below, respectively, the longitudinal centerline 622.

The top surface 630 includes two sides or facets 636 and 637 extending forwardly from the base portion 624 of the adapter 612 and disposed on opposite lateral sides of the longitudinal centerline 622 and which intersect or merge with each other along a common top edge 638. The common top edge 638 extends for a major length of the nose portion 626 of the adapter 612 and is generally centralized along the longitudinal centerline 622 thereof.

In this embodiment of the invention, each side or facet 636, 637 forming the top surface 630 of the adapter 612 has a generally planar configuration. Moreover, in this form of the invention, the sides 636, 637 forming the top surface 630 of the adapter 612 are each slanted at an angle of about 35° relative to a horizontal plane.

In the embodiment of the adapter illustrated in FIG. 26, the bottom surface 640 of the adapter 612 has a complementary configuration relative to the top surface 630. That is, the lower or bottom surface 640 of the nose portion 626 of adapter 612 has two sides 646, 647 joined or which are merged relative to each other by a common bottom edge 648 and are disposed on opposite lateral sides of the longitudinal centerline 622 of the adapter 612. The two lower or bottom sides 646, 647 likewise extend forwardly from the base portion 624 of the adapter 612 toward the free end thereof The common edge 648 joining or merging the two sides 646, 647 forming the bottom surface 640 extends for a major length of the nose portion 626 of the adapter and is disposed generally centrally relative to the longitudinal centerline 622.

In this illustrated form of the invention, the two sides 646, 647 forming the bottom or lower surface 640 of the adapter 612 each have a generally planar configuration. Moreover, in this form of the invention, the sides 646, 647 forming the lower or bottom surface 640 of the nose portion of the adapter 612 are each slanted at an angle of about 35° relative to a horizontal plane.

In the embodiment of the invention illustrated in FIG. 26, the angularly disposed sides 636 and 646 partially forming the top and bottom surfaces 630 and 640, respectively, and which are disposed to one side of the longitudinal centerline 622 of the adapter 612, are likewise joined to each other along a common side edge 639 extending longitudinally forward from the base portion 624 of the adapter 612. Similarly, with the embodiment of the invention illustrated in FIG. 26, the angularly disposed sides 637 and 647 partially forming the top and bottom surfaces 630 and 640, respectively, and which are arranged on an opposite side of the longitudinal axis 622 of the adapter 612 are joined to each other along a common side edge 649 extending longitudinally forward from the base portion 624 of the adapter 612.

The generally planar configurations of the sides 636, 637 and 646, 647 of the top and bottom surfaces 630 and 640, respectively, provides the nose portion 626 of the adapter 612 with a generally rectangular cross-sectional configuration having an increasing cross-sectional area as measured from a forward end thereof Suffice it to say, in the embodiment of the invention illustrated in FIG. 26, a major lengthwise section of the nose portion 626 of the adapter 612 is angularly offset or canted relative to the base portion 624 of the adapter 612.

The nose portion 626 of the adapter 612 likewise defines a bore 650 or opening extending through the adapter 612 and open at opposite ends thereof for accommodating a suitable fastener (not shown) used to hold and maintain the adapter 612 and tooth 614 in operable combination relative to each other. As illustrated in FIG. 26, the bore 650 defines an axis 652 which can be disposed generally normal to at least one of the sides 636, 637 or 646, 647 of the top and bottom surfaces, respectively, to facilitate fabrication of the bore 650. Notably, the bore 650 opens at opposite ends to diametrically opposed sides 636, 647 of the top and bottom surfaces 630, 640, respectively, of the nose portion 626 of adapter 612.

FIG. 27 illustrates still another form for the adapter 12 which embodies features of the present invention. This alternative form of adapter is designated generally by reference numeral 712. The elements of this alternative form of the adapter that are identical or functionally analogous to those components discussed above regarding adapter 12 are designated by reference numerals identical to those used above with the exception that this embodiment used reference numerals in the seven-hundred series.

In this embodiment of the invention, the adapter 712 includes a base portion 724 and a nose portion 726 in axially aligned relationship relative to each other and defines a centerline 722. Like adapter 12, adapter 712 is preferably fabricated from a forging operation to extend the durability and, thus, expected life of the adapter 712. As discussed above, the nose portion 726 of adapter 712 has an elongated tapered configuration with top and bottom surfaces 730 and 740, respectively, sloping or slanting and converging toward a free end of the nose portion 726. As shown, the top and bottom edges 730 and 740, respectively, are disposed above and below, respectively, the longitudinal centerline 722.

The top surface 730 includes two sides 736 and 737 extending forwardly from the base portion 724 of the adapter 712 and disposed on opposite lateral sides of the longitudinal centerline 722 and which intersect or merge with each other along a common top edge 738. The common top edge 738 extends for a major length of the nose portion 726 of the adapter 712 and is generally centralized along the longitudinal centerline 722 thereof.

In this embodiment of the invention, each side 736, 737 forming the top surface 730 of the adapter 712 has a generally planar configuration. Moreover, in this form of the invention, the sides 736, 737 forming the top surface 730 of the adapter 712 are each slanted at an angle of about 45° relative to a horizontal plane.

In the embodiment of the adapter illustrated in FIG. 27, the bottom surface 740 of the adapter 712 has a configuration similar relative to the top surface 730. That is, the lower or bottom surface 740 of the nose portion 726 of adapter 712 has two sides 746, 747 joined or which are merged relative to each other by a common bottom edge 748 and are disposed on opposite lateral sides of the longitudinal centerline 722 of the adapter 712. The two lower or bottom sides 746, 747 likewise beyond forwardly from the base portion 724 of the adapter 712 toward the free end thereof The common edge 748 joining or merging the two sides 746, 747 forming the bottom surface 740 extends for a major length of the nose portion 726 of the adapter 712 and is disposed generally centrally relative to the longitudinal centerline 722.

In this illustrated form of the invention, each side 746, 747 forming the bottom or lower surface 740 of the adapter 712 has a generally planar configuration. Notably, however, with this form of the invention, the sides 746, 747 forming the lower or bottom surface 740 of the nose portion 726 of the adapter 712 are angularly disposed at an angle relative to a horizontal plane different from the slanted disposition of the sides 736, 737 forming the top surface 730 of the nose portion 726 of the adapter 712. In the embodiment of the invention illustrated in FIG. 27, the sides 746, 747 of the bottom surface 740 of the nose portion 726 of the adapter 712 are each slanted at an angle of about 35° relative to a horizontal plane. As will be appreciated by those skilled in the art, the angular disposition of the sides 736, 737 and 746, 747 forming the top and bottom surfaces 730, 740, respectively, of the nose portion 726 of the adapter 712 can be reversed if so desired. That is, the sides 736, 737 of the top surface 730 can be disposed at an angle of about 35° relative to a horizontal plane while the sides 746, 747 of the bottom surface 740 of the nose portion 726 of the adapter 712 can be angularly offset an at angle of 45° or greater relative to a horizontal plane without detracting or departing from the spirit and scope of the present invention.

In this embodiment of the invention, the angularly disposed sides 736 and 746 partially forming the top and bottom surfaces 730 and 740, respectively, and which are disposed to one side of the longitudinal centerline 722 of the adapter 712, are likewise joined to each other along a common side edge 739 extending longitudinally forward from the base portion 724 of the adapter 712. Similarly, with the embodiment of the invention illustrated in FIG. 27, the angularly disposed sides 737 and 747 partially forming the top and bottom surfaces 730 and 740, respectively, and which are arranged on an opposite side of the longitudinal axis 722 of the adapter 712 are joined to each other along a common side edge 749 extending longitudinally forward from the base portion 724 of the adapter 712.

The generally planar configurations of the sides 736, 737 and 746, 747 of the top and bottom surfaces 730 and 740, respectively, provides the nose portion 726 of the adapter 712 with a generally rectangular cross-sectional configuration having an increasing cross-sectional area as measured from a forward end thereof Suffice it to say, in the embodiment of the invention illustrated in FIG. 27, a major lengthwise section of the nose portion 726 of the adapter 712 is angularly offset or canted relative to the base portion 724 of the adapter 712.

The nose portion 726 of the adapter 712 likewise defines a bore 750 or opening extending through the adapter 712 and open at opposite ends thereof for accommodating the fastener (not shown) for interconnecting the adapter 712 to a suitably shaped digging or excavating tooth. As illustrated in FIG. 27, the bore 750 defines an axis 752 which is disposed generally normal to at least one of the sides 736, 737 or 746, 747 of the top and bottom surfaces, respectively, to facilitate fabrication of the bore 750. Notably, the bore 750 opens at opposite ends to diametrically opposed sides 736, 747 of the top and bottom surfaces 730, 740, respectively, of the nose portion 726 of the adapter 712.

FIG. 28 illustrates still another embodiment of an adapter embodying principles of the present invention. This alternative form of adapter is designated generally by reference numeral 812. The embodiment of the invention illustrated in FIG. 28 is substantially similar to that illustrated and described above with respect to FIG. 26 except the angular disposition of the sides forming the top and bottom surfaces of the nose portion of the adapter are each offset and an angle ranging between about 55° to about 65° relative to a horizontal plane.

Yet another embodiment of an adapter embodying principles of the present invention is illustrated in FIG. 29. This alternative form of adapter is designated generally by reference numeral 912. The elements of this alternative form of the adapter that are identical or functionally analogous to those components discussed above regarding adapter 12 are designated by reference numerals identical to those used above with the exception that this embodiment used reference numerals in the nine-hundred series.

In this embodiment of the invention, the adapter 912 includes a base portion 924 and a nose portion 926 in axially aligned relationship relative to each other and defines a centerline 922. Like adapter 12, adapter 912 is preferably fabricated from a forging operation to extend the durability and, thus, life of the adapter 912. The nose portion 926 of adapter 912 has an elongated tapered configuration with top and bottom surfaces 930 and 940, respectively, sloping or slanting and converging toward the free end of the nose portion 926. As shown, the top and bottom surfaces 930 and 940, respectively, are disposed above and below, respectively, the longitudinal centerline 922.

The top surface 930 includes two sides 936 and 937 extending forwardly from the base portion 924 of the adapter 912 and disposed on opposite lateral sides of the longitudinal centerline 922 and which intersect or merge with each other along a common top edge 938. The common top edge 938 extends for a major length of the nose portion 926 of the adapter 912 and is generally centralized along the longitudinal centerline 922 thereof.

In this embodiment of the invention, each side 936, 937 forming the top surface 930 of the adapter 912 has a generally planar configuration. Moreover, in this form of the invention, the sides 936, 937 forming the top surface 930 of the adapter 912 are each slanted at an angle of about 25° relative to a horizontal plane.

In the embodiment of the adapter illustrated in FIG. 29, the bottom surface 940 of the adapter 912 has two sides 946, 947 joined or which are merged relative to each other by a common bottom edge 948 and are disposed on opposite lateral sides of the longitudinal centerline 922 of the adapter 912. The two lower or bottom sides 946, 947 likewise extend forwardly from the base portion 924 of the adapter 912 toward the free end thereof The common edge 948 joining or merging the two sides 946, 947 forming the bottom surface 940 extends for a major length of the nose portion 926 of the adapter 912 and is disposed generally centrally relative to the longitudinal centerline 922.

In this illustrated form of the invention, each side 946, 947 forming the bottom or lower surface 940 of the adapter 912 has a generally planar configuration. Moreover, with this form of the invention, the sides 946, 947 forming the lower or bottom surface 940 of the nose portion of the adapter 912 are each slanted at an angle of about 45° relative to a horizontal plane.

In this embodiment of the invention, the angularly disposed sides 936 and 946 partially forming the top and bottom surfaces 930 and 940, respectively, and which are disposed to one side of the longitudinal centerline 922 of the adapter 912, are likewise joined to each other along a generally vertical side surface 939 extending longitudinally forward from the base portion 924 of the adapter 912. Similarly, with the embodiment of the invention illustrated in FIG. 29, the angularly disposed sides 937 and 947 of the top and bottom surfaces 930 and 940, respectively, and which are arranged on an opposite side of the longitudinal axis 922 of the adapter 912, are joined to each other along a generally vertical side surface 949 extending longitudinally forward from the base portion 924 of the adapter 912.

The nose portion 926 of the adapter 912 likewise defines a bore or opening 950 extending through the adapter 912 and open at opposite ends thereof for accommodating a suitable fastener (not shown) used to hold used to hold and maintain the adapter 912 and excavating or digging tooth in operable combination relative to each other. As illustrated in FIG. 29, the bore 950 defines an axis 952 which is disposed generally normal to at least one of the sides 936, 937 or 946, 947 of the top and bottom surfaces 930 or 940, respectively, to facilitate fabrication of the bore 950.

Yet another embodiment of an adapter embodying principles of the present invention is illustrated in FIG. 30. This alternative form of adapter is particularly useful on loader machine applications and is designated generally by reference numeral 1012. The elements of this alternative form of the adapter that are identical or functionally analogous to those components discussed above regarding adapter 12 are designated by reference numerals identical to those used above with the exception that this embodiment used reference numerals in the one thousand series.

In this embodiment of the invention, the adapter 1012 includes a base portion 1024 and a nose portion 1026 in axially aligned relationship relative to each other and defines a centerline 1022. The nose portion 1026 of adapter 1012 has an elongated tapered configuration with top and bottom surfaces 1030 and 1040, respectively, sloping or slanting and converging toward the free end of the nose portion 1026. As shown, the top and bottom surfaces 1030 and 1040, respectively, are disposed above and below, respectively, the longitudinal centerline 1022.

The top surface 1030 includes two sides or facets 1036 and 1037 extending forwardly from the base portion 1024 of the adapter 1012 and disposed on opposite lateral sides of the longitudinal centerline 1022 and which intersect or merge with each other along a common top edge 1038. The common top edge 1038 extends for a major length of the nose portion 1026 of the adapter 1012 and is generally centralized along the longitudinal centerline 1022 thereof.

In this embodiment of the invention, each side or facet 1036, 1037 forming the top surface 1030 of the adapter 1012 has a generally planar configuration. Moreover, in this form of the invention, the sides 1036, 1037 forming the top surface 1030 of the adapter 1012 are each slanted at an angle ranging between about 35° and about 55° relative to a horizontal plane.

In the embodiment of the adapter illustrated in FIG. 30, the bottom surface 1040 of the adapter 1012 has two sides 1046, 1047 joined or which are merged relative to each other by a common bottom edge 1048 and are disposed on opposite lateral sides of the longitudinal centerline 1022 of the adapter 1012. The two lower or bottom sides 1046, 1047 likewise extend forwardly from the base portion 1024 of the adapter 1012 toward the free end thereof The common edge 1048 joining or merging the two sides 1046, 1047 forming the bottom surface 1040 extends for a major length of the nose portion 1026 of the adapter 1012 and is disposed generally centrally relative to the longitudinal centerline 1022.

In this illustrated form of the invention, each side or facet 1046, 1047 forming the bottom or lower surface 1040 of the adapter 1012 has a generally planar configuration. Moreover, with this form of the invention, the sides 1046, 1047 forming the lower or bottom surface 1040 of the nose portion of the adapter 1012 are each downwardly slanted to form an included angle of about 5° to 15° with a horizontal plane.

In this embodiment of the invention, the angularly disposed sides 1036 and 1046 partially forming the top and bottom surfaces 1030 and 1040, respectively, and which are disposed to one side of the longitudinal centerline 1022 of the adapter 1012, are likewise joined to each other along a common side edge 1039 extending longitudinally forward from the base portion 1024 of the adapter 1012. Similarly, with the embodiment of the invention illustrated in FIG. 30, the angularly disposed sides 1037 and 1047 of the top and bottom surfaces 1030 and 1040, respectively, and which are arranged on an opposite side of the longitudinal axis 1022 of the adapter 1012, are joined to each other along a common side edge 1049 extending longitudinally forward from the base portion 1024 of the adapter 1012.

The nose portion 1026 of the adapter 1012 likewise defines a bore or opening 1050 extending through the adapter 1012 and open at opposite ends thereof for accommodating a suitable fastener (not shown) used to hold used to hold and maintain the adapter 1012 and excavating or digging tooth in operable combination relative to each other. As illustrated in FIG. 30, the bore 1050 defines an axis 1052 which is disposed generally normal to at least one of the sides or facets 1036, 1037 of the top surface 1030 to facilitate fabrication of the bore 1050.

Yet another embodiment of an adapter embodying principles of the present invention is illustrated in FIG. 31. This alternative form of adapter is particularly usefull on loader machine applications and is designated generally by reference numeral 1112. The elements of this alternative form of the adapter that are identical or functionally analogous to those components discussed above regarding adapter 12 are designated by reference numerals identical to those used above with the exception that this embodiment used reference numerals in the one thousand-one hundred series.

In this embodiment of the invention, the adapter 1112 includes a base portion 1124 and a nose portion 1126 in axially aligned relationship relative to each other and defines a centerline 1122. The nose portion 1126 of adapter 1112 has an elongated tapered configuration with top and bottom surfaces 1130 and 1140, respectively, sloping or slanting and converging toward the free end of the nose portion 1126. As shown, the top and bottom surfaces 1130 and 1140, respectively, are disposed above and below, respectively, the longitudinal centerline 1122.

The top surface 1130 includes two sides or facets 1136 and 1137 extending forwardly from the base portion 1124 of the adapter 1 112 and disposed on opposite lateral sides of the longitudinal centerline 1122 and which intersect or merge with each other along a common top edge 1138. The common top edge 1138 extends for a major length of the nose portion 1126 of the adapter 1112 and is generally centralized along the longitudinal centerline 1122 thereof.

In this embodiment of the invention, each side or facet 1136, 1137 forming the top surface 1130 of the adapter 1112 has a generally planar configuration. Moreover, in this form of the invention, the sides 1136, 1137 forming the top surface 1130 of the adapter 1112 are each slanted at an angle ranging between about 35° and about 55° relative to a horizontal plane.

In the embodiment of the adapter illustrated in FIG. 31, the bottom surface 1140 of the adapter 1112 has a generally flat side or facet 1146 extending thereacross so as to be disposed on opposite lateral sides of and extending generally normal to the longitudinal centerline 1122 of the adapter 1112 and generally parallel to a horizontal plane. The lower side 1146 extends forwardly from the base portion 1124 of the adapter 1112 toward the free end thereof.

In this embodiment of the invention, the angularly disposed side 1136 partially forming the top surface 1130 is joined to the bottom surface 1140 along a common side edge 1139 extending longitudinally forward from the base portion 1124 of the adapter 1112. Similarly, with the embodiment of the invention illustrated in FIG. 31, the angularly disposed side 1137 partially forming the top surface 1130 is joined to the bottom surface 1 140 along a common side edge 1149 extending longitudinally forward from the base portion 1024 of the adapter 1012.

The nose portion 1126 of the adapter 112 likewise defines a bore or opening 1150 extending through the adapter 1112 and open at opposite ends thereof for accommodating a suitable fastener (not shown) used to hold used to hold and maintain the adapter 1112 and excavating or digging tooth in operable combination relative to each other. As illustrated in FIG. 31, the bore 1150 defines an axis 1152 which is disposed generally normal to at least one of the sides or facets 1136, 1137 of the top surface 1130 to facilitate fabrication of the bore 1150.

Although not specifically illustrated, it should be appreciated by those skilled in the art the opposed sides of either the top or bottom surfaces of the adapter do not necessarily need to be disposed at the same angle relative to each other or relative to a generally horizontal plane. That is, there can be some angular variation between opposed sides of either the top or bottom surfaces on the adapter without detracting or departing from the spirit and scope of the present invention.

As will be appreciated by those skilled in the art, and to enhance the conjuncture between the tooth and adapter, the cross-sectional configurations of the nose portion of the adapter and the blind cavity defined by the tooth will generally correspond relative to each other. Accordingly, if the nose portion of the adapter has a cross-sectional configuration similar to that illustrated in FIG. 26, the blind cavity defined at the rear end of the tooth will have a similar cross-sectional configuration thereby enhancing the conjuncture therebetween. Similarly, if the nose portion of the adapter has a cross-sectional configuration similar to that illustrated in FIG. 29, the blind cavity opening to the rear end of the tooth will have a corresponding cross-sectional configuration.

The present invention offers several distinct features heretofore unknown in prior art devices. First, with the present invention, the cross sectional size or area of the nose portion of the adapter can be fabricated from the same amount of material as heretofore known comparable adapters while offering enhanced strength and rigidity. Thus, and while neither increasing the material nor weight of the adapter, the strength and rigidity thereof is significantly increased. By canting the cross sectional configuration of the nose portion of the adapter relative to the base portion, a significant increase in material thickness is provided in both the vertical and horizontal directions, thus, permitting the adapter to withstand significantly higher forces. As will be appreciated, the angular orientation of the sides forming the top and bottom surfaces of the adapter can be shaped during fabrication for different operations and yet offer enhanced strength and durability beyond cross sectional configurations disposed in the conjuncture of a conventionally configured multipiece tooth assembly. Thus, the cross-sectional design of the conjuncture between the tooth and adapter of the multi-piece tooth assembly can be specifically configured to coincide with expectant vertical or horizontal increases associated with the earth engaging tool.

Second, with the present invention, the angular orientation of the those components of the digging tooth and adapter forming the conjuncture therebetween allows for self-centering of a relatively loose fitted tooth on the adapter. Moreover, the tooth and adapter components of the multipiece tooth assembly have been significantly modified from previous multipiece digging tooth designs to purposefully distinguish the component parts of the present invention from the prior art. That is, the canted or angled configuration of the nose portion of the adapter relative to the base or mounting portion, while offering those operational benefits described above, furthermore serves to distinguish the adapter of the present invention from all other heretofore known designs. Similarly, the angled or canted configuration of the blind cavity or pocket at the rear end portion of the digging tooth distinguishes the excavating tooth of the present invention from all others.

Moreover, and as will be appreciated by those skilled in the art, the angled orientation of the retaining pin structure accomplished with the present invention offers enhanced advantages over either vertical or horizontally disposed retaining pin systems. As will be appreciated, arranging the axis of the bore for accommodating and holding the retaining pin at an angle generally normal to opposed sides of the angled top and bottom surfaces of the adapter facilitates fabrication of the adapter. Also, the angular orientation of the retaining pin allows for superior access thereto to effect repair and/or replacement of the digging tooth. Furthermore, the materials being excavated and the vertical and horizontal movements of the excavating tooth assembly, as well as the forces resulting therefrom, have significantly lesser effect on the angularly disposed retaining pin of the present invention as compared with heretofore known retaining pin systems. Additionally, the slanted or canted orientation of the retainer pin structure offers ergonomic advantages during repair or replacement of the digging tooth. Such ergonomic advantages are more fully realized with the bucket or loading implement in a lower vertical disposition. Moreover, the slanted orientation of the retaining pin structure facilitates assembly and proper orientation of the digging or excavating tooth relative to the adapter thereby allowing the user to take full advantage of the deign characteristics associated with such digging teeth.

From the foregoing, it will be observed that numerous modifications and variations can be effected without departing from the true spirit and scope of the novel concept of the present invention. It will be appreciated that the present disclosure is intended to set forth exemplifications of the present invention and are not intended to limit the invention to the specific embodiments illustrated. The disclosure is intended to cover by the appended claims all such modifications and colorful variations as fall within the spirt and scope of the claims.

What is claimed is:

1. An adapter for a multipiece excavating tooth assembly, comprising:

an elongated member having a base portion and an elongated nose portion axially arranged relative to each other along a longitudinal centerline of said member, said base portion being configured to permit attachment of said adapter to excavating equipment, and wherein said elongated nose portion has top and bottom angled surfaces disposed generally above and below the longitudinal centerline of said member, respectively, with the top surface of said nose portion having two downwardly disposed and angled sides arranged on opposite lateral sides of the longitudinal centerline of said member, and with the bottom surface of said nose portion having two upwardly disposed and angled sides arranged on opposite lateral sides of the longitudinal centerline of said member such that the nose portion of said member is provided with four sides, with the two angled sides on said top surface being joined to each other along a common edge extending longitudinally of said member to enhance support surface area exposure along substantially an entire length of said top surface, and with the two angled sides on said bottom surface being joined to each other along a common edge extending longitudinally of said member to enhance support surface area exposure along substantially an entire length of said bottom surface, and with said nose portion further defining a recess extending along an axis intersecting opposite sides on the top and bottom surfaces of the nose portion of said member for accommodating a pin retaining apparatus.

2. The adapter according to claim 1 wherein the top and bottom surfaces of said member slope downwardly toward a free end of the nose portion of the adapter.

3. The adapter according to claim 1 wherein said elongated member is formed as a result of a forging operation to add strength and durability to said adapter.

4. The adapter according to claim 1 wherein each downwardly disposed and angled side on the top surface of said member has a generally planar configuration.

5. The adapter according to claim 1 wherein each upwardly disposed and angled side on the bottom surface of said member has a generally planar configuration.

6. The adapter according to claim 1 wherein the recess defined in the nose portion of the elongated number includes a bore open at opposite ends and defining an axis extending generally normal to one of said downwardly disposed sides on the top surface of said member.

7. The adapter according to claim 6 wherein the axis defined by said bore extends generally normal to one of said upwardly disposed sides on the bottom surface of said member to facilitate fabrication of the adapter.

8. The adapter according to claim 1 wherein each downwardly disposed side on the top surface of said member is disposed at an angle ranging between about 25° and about 65° relative to a horizontal plane.

9. The adapter according to claim 1 wherein each upwardly disposed side on the bottom surface of said member is disposed at an angle ranging between about 25° and about 65° relative to a horizontal plane.

10. The adapter according to claim 1 wherein the downwardly disposed sides of the top surface on opposite lateral sides of the longitudinal axis of the nose portion of said member are joined along common edges to the respective upwardly disposed sides of the bottom surface on opposite lateral sides of the longitudinal axis of said member.

11. The adapter according to claim 1 wherein the sides of said top and bottom surfaces on the nose portion of said member are configured relative to each other to provide a generally rhombus-like cross-sectional configuration to at least a major lengthwise portion of the nose portion of said member.

12. An excavating tooth for a multipiece excavating tooth assembly, said excavating tooth assembly comprising:

an elongated generally wedge shaped member having a ground penetrating edge extending transversely across a forward end thereof, said ground penetrating edge extending generally parallel to an edge of excavating equipment when said tooth is attached thereto, and with a rear end of said elongated member defining a blind cavity open to the rear end of said elongated member to allow said tooth to be operably coupled to an adapter forming part of said excavating tooth assembly, and wherein said blind cavity includes top and bottom angled surfaces, with each top and bottom surface of said blind cavity including two angled sides each extending at an acute angle ranging between about 30° and about 60° relative to the ground penetrating edge, and wherein each angled side of said top and bottom surfaces is arranged on opposite lateral sides of a longitudinal centerline of said member, with the angled sides of the top and bottom surfaces being joined to each other along a common edge extending therebetween such that, for a majority of the length thereof, said cavity is provided with a cross-sectional configuration of an equilateral parallelogram, and wherein said tooth further defines a pair of axially aligned bores disposed along an axis intersecting opposite sides of said top and bottom surfaces of said cavity to allow retainer pin structure to pass therethrough.

13. The excavating tooth according to claim 12 wherein the top and bottom surfaces of said cavity angularly converge toward each other and toward the forward end of said tooth.

14. The excavating tooth according to claim 12 wherein said tooth is formed as a result of a forging process to add strength and durability to said tooth.

15. The excavating tooth according to claim 12 wherein the sides of said top surface forming part of said blind cavity have a generally planar configuration.

16. The excavating tooth according to claim 12 wherein the sides of said bottom surface forming part of said blind cavity have a generally planar configuration.

17. The excavating tooth according to claim 12 wherein the axis defined by said pair of axially aligned bores extends generally normal to one of said angled sides defining the top surface of said blind cavity defined by said elongated member.

18. The excavating tooth according to claim 12 wherein the angled sides of said top and bottom surfaces of said cavity, disposed to a respective lateral side of the longitudinal axis of said elongated member, are joined to each other along a common radiused edge.

19. The excavating tooth according to claim 12 wherein the common edge joining the two angled sides of the top surface has a radiused configuration.

20. The excavating tooth according to claim 12 wherein the common edge joining the two angled sides of the bottom surface has a radiused configuration.

21. The excavating tooth according to claim 12 wherein each common edge joining the two angled sides of the top and bottom surface has a radiused configuration.

22. An adapter for a multipiece excavating tooth assembly, comprising:

a member having a base portion configured toward a rear end thereof for attachment to excavating equipment and having an elongated free ended nose portion extending forwardly from the base portion, and wherein said nose portion has four longitudinally extending and angled sides, with any two sides of said nose portion being joined along and angularly diverging from a common edge to provide the nose portion of said member with a cross-sectional configuration of an equilateral parallelogram along a major lengthwise portion thereof, with the cross-sectional configuration of said nose portion being angularly offset at an angle of about 45° relative to the base portion to add strength and rigidity to the adapter.

23. The adapter according to claim 22 wherein the nose portion of said member further defines a recess having an axis disposed at an angle of about 45° relative to a horizontal plane.

24. The adapter according to claim 23 wherein the axis of said recess extends generally normal to at least two elongated sides defined by the nose portion of said member.

25. The adapter according to claim 23 wherein each angled side on the nose portion of said member has a sloping configuration converging toward a free end of the adapter.

26. The adapter according to claim 25 wherein two sides of the nose portion of said member define a top surface, and wherein two sides of the nose portion of said member define a bottom surface, with said top and bottom surfaces being disposed on opposite lateral sides of a longitudinal axis of said adapter.

27. The adapter according to claim 26 wherein the two angled sides defining said top surface of the nose portion of the member angularly depend from a common top edge extending longitudinally along the nose portion of said member, and wherein the two angled sides defining said bottom surface angularly extend from a common bottom edge extending longitudinally along the nose portion of said member.

28. The adapter according to claim 27 wherein said top and bottom common edges are vertically spaced apart by a first distance which is greater than a second distance horizontally separating diametrically opposed sides of said top and bottom surfaces.

29. The adapter for a multipiece excavating tooth assembly according to claim 27 wherein the common top edge joining the two angled sides defining the top surface of said nose portion has a radiused configuration.

30. The adapter for a multipiece excavating tooth assembly according to claim 27 wherein the common bottom edge joining the two angled sides defining the bottom surface of said nose portion has a radiused configuration.

31. The adapter according to claim 23 wherein said member is fabricated as a result of a forging process thereby adding strength and durability to said adapter.

32. The adapter for a multipiece excavating tooth assembly according to claim 22 wherein the common edge joining any two sides of said nose portion has a radiused configuration.

33. An excavating tooth for a multipiece excavating tooth assembly, said excavating tooth comprising:

a rigid elongated generally wedge shaped member having a ground penetrating edge extending transversely across a forward end of said member, said member further defining a blind cavity disposed toward and open to a rear end of said member, said blind cavity having four longitudinally extending and angled sides, with any two adjacent sides of said cavity being joined to each other along and angularly diverging from a common edge to provide said cavity with a cross-sectional configuration of an equilateral parallelogram along a major lengthwise portion thereof, and with the cross-sectional configuration of said blind cavity decreasing in area as measured from said rear end of said member while maintaining said cross-sectional configuration of an equilateral parallelogram, and wherein the cross-sectional configuration of said cavity is canted at an angle of about 45° relative to the ground penetrating edge of said member.

34. The excavating tooth according to claim 33 wherein said rear portion of said member further defines a recess opening to said blind cavity and defining an axis disposed at an angle of about 45° relative to the ground penetrating edge of said member.

35. The excavating tooth according to claim 33 wherein said member is fabricated as a result of a forging process to add strength and durability to said tooth.

36. The excavating tooth according to claim 33 wherein the common edge joining any two adjacent sides of said cavity has a radiused configuration.

37. An excavating tooth assembly, comprising:

an adapter having a base portion and a nose portion axially arranged relative to each other along a longitudinal centerline of said adapter, said base portion being configured to permit attachment of said adapter to excavating equipment, and wherein said nose portion has top and bottom angled surfaces disposed generally above and below the longitudinal centerline of said adapter, respectively, with the upper surface of said nose portion having two angled sides extending forwardly from a rear end of and for a major lengthwise distance of said nose portion, and with the bottom surface of said nose portion having two angled sides extending forwardly from a rear end of and for a major lengthwise distance of said nose portion such that the nose portion of said adapter is provided with a cross-sectional configuration of an equilateral parallelogram, and with each side of said upper and lower surfaces being arranged on opposite lateral sides of the longitudinal centerline of said adapter, and wherein the two angled sides on said top surface are planar in configuration and are joined to each other along a common top edge extending longitudinally along the nose portion of said adapter to enhance support surface area exposure along substantially an entire length of said top surface, and wherein the two angled sides on said bottom surface are planar in configuration and are joined to each other along a common bottom edge extending longitudinally along the nose portion of the adapter to enhance support surface area exposure alone substantially an entire length of said bottom surface of the nose portion of said adapter, and with said nose portion further defining a recess disposed along an axis intersecting diametrically opposed sides on the top and bottom surfaces of said adapter;

an excavating tooth having a forward end and a rearward end, with the rearward end of said tooth defining a socket open to the rearward end of said tooth and configured to accommodate said nose portion of said adapter therewithin, said tooth further including an opening disposed on said tooth for operative combination with the recess in said adapter when said tooth and adapter are arranged in operable combination relative to each other; and retaining pin structure accommodated within the recess on said adapter and at least partially passing through the opening in said tooth thereby releasably fixing said tooth and said adapter in operable combination relative to each other.

38. The excavating tooth assembly according to claim 37 wherein the axis defined by the recess in said adapter extends generally normal to one of said angled sides on the top surface of said member.

39. The excavating tooth assembly according to claim 38 wherein the axis of the recess in said adapter extends at an angle of about 45° relative to a horizontal plane.

40. The excavating tooth assembly according to claim 37 wherein the axis defined by the recess of said adapter extends generally normal to one of said angled sides on the bottom surface of said adapter.

41. The excavating tooth assembly according to claim 40 wherein the axis of the recess in said adapter extends at an angle of about 45° relative to a horizontal plane.

42. The excavating tooth assembly according to claim 37 wherein each angled side on the top surface of said adapter is disposed at an angle ranging between about 30° and about 60° relative to a horizontal plane.

43. The adapter according to claim 37 wherein the sides of said upper and bottom surfaces commonly disposed in a lateral perspective relative to the longitudinal centerline of the nose portion of said member are joined along longitudinal common edges to provide said nose portion of said adapter with a generally rectangular-like cross-sectional configuration.

44. The excavating tooth assembly according to claim 37 wherein the upper and bottom surfaces of a forward end of said nose portion of said adapter and corresponding areas of said tooth are configured with supports for stabilizing said adapter and tooth during operation of said excavating tooth assembly.

45. The excavating tooth assembly according to claim 37 wherein said common top edge joining the two angled sides on said top surface of the nose portion of said adapter has a radiused configuration.

46. The excavating tooth assembly according to claim 37 wherein the common bottom edge joining the two angled sides on the bottom surface of said adapter has a radiused configuration.

47. An excavating tooth assembly, comprising:

an elongated generally wedge shaped excavating tooth having a ground penetrating edge extending transversely across a forward end thereof, said ground penetrating edge extending generally parallel to an edge of excavating equipment when said tooth is attached thereto, said excavating tooth defining a blind cavity open to the rear end of said tooth, and wherein said blind cavity includes top and bottom angled surfaces, with each top and bottom angled surface of said blind cavity including two angled sides each extending at an acute angle ranging between about 30° and about 60° relative to the ground penetrating edge, and wherein each angled side of said top and bottom surfaces is arranged on opposite lateral sides of a longitudinal centerline of said tooth, and wherein the two angled sides of said top and bottom surfaces, respectively, have a common edge extending therebetween such that, for a majority of the length thereof, said cavity is provided with a cross-sectional configuration of an equilateral parallelogram, and wherein said tooth further defines a recess disposed along an axis intersecting opposite sides of said top and bottom surfaces of said cavity;

an adapter having a nose portion configured to fit endwise within said blind cavity of said tooth, said nose portion defining an opening arranged in general fore-and-aft alignment with said recess defined by said tooth when said tooth and adapter are arranged in operable combination relative to each other, and wherein said adapter further includes a base portion for permitting said adapter to be connected to excavating equipment; and retaining pin apparatus configured for accommodation within said opening in said adapter and passing, at least partially, through the recess in said tooth for attaching said tooth and adapter in operable combination relative to each other.

48. The excavating tooth assembly according to claim 47 wherein the top and bottom surfaces of said cavity defined by said tooth converge toward the free end of said tooth and toward each other.

49. The excavating tooth assembly according to claim 47 wherein the axis defined by said recess in said tooth extends generally normal to one of the sides defining the top surface of the cavity defined by said tooth.

50. The excavating tooth assembly according to claim 47 wherein said adapter and said tooth each define corresponding support horizontal surfaces thereon for stabilizing said tooth and adapter during operation of said excavating tooth assembly.

51. A multipiece excavating tooth assembly, comprising:

an adapter having a base portion configured toward a rear end thereof for attachment to excavating equipment and having an elongated free ended nose portion defining an axis and extending forwardly from the base portion, and wherein said nose portion has a cross-sectional configuration defined by four angularly slanted and generally planar sides, with two any two planar sides being disposed to opposite sides of said axis and which are joined to each other along a longitudinally extending common edge disposed along said axis and extending forwardly from a rear end of the nose portion such that, for a major length thereof, said nose portion of said adapter is provided with a cross-sectional configuration of a equilateral parallelogram, with each angularly slanted and generally planar side forming an acute angle of about 45° relative to a generally horizontal plane;

an excavating tooth configured to fit along and about a lengthwise section of the nose portion of said adapter; and retainer pin structure for holding said tooth and adapter in operable relation relative to each other.

52. The multi-piece excavating tooth assembly according to claim 51 wherein the nose portion of said adapter defines a bore open at opposite ends and extending at an angle of about 45° relative to a horizontal plane to promote insertion of said pin structure into operable combination with said adapter and tooth.

53. The multipiece excavating tooth assembly according to claim 52 wherein said tooth defines a pair of axially aligned holes, which generally align with the bore defined by said adapter when said multipiece tooth assembly is assembled to permit said retainer pin structure to be inserted at least partially through each hole defined by said tooth.

54. The multipiece excavating tooth assembly according to claim 51 wherein the angularly sided cross section of the nose portion of said adapter increases in area as measured from the free end thereof toward the rear end thereof while maintaining an equilateral cross-sectional configuration.

55. The multipiece excavating tooth assembly according to claim 51 wherein the two upwardly slanted generally planar sides on the nose portion of said adapter combine to define a support surface for stabilizing said tooth on said adapter during operation of said multipiece excavating tooth assembly, and wherein the support surface defined by said two upwardly slanted and generally planar sides provide a cumulative support surface area having a greater dimension than would be provided by a horizontal surface extending between diametrically opposed lateral edges of said two slanted sides.

56. The multipiece excavating tooth assembly according to claim 51 wherein said tooth is formed as a result of a forging operation to add strength and rigidity thereto.

57. The multipiece excavating tooth assembly according to claim 51 wherein said adapter is formed as a result of a forging operation to add strength and rigidity thereto.

58. The multi-piece excavating tooth assembly according to claim 51 wherein said nose portion further defines a channel extending across the upper common edge of the nose portion of said adapter in a direction generally normal to said axis.

59. The multi-piece excavating tooth assembly according to claim 58 wherein said tooth defines a pair of axially aligned holes which generally align in a fore-and-aft direction with the channel defined by the nose portion of said channel when said multi-piece excavating tooth assembly is assembled to permit said retainer pin structure to be inserted, at least partially, through the holes in said tooth such that a lengthwise portion of said retainer pin structure passes endwise through the channel thereby releasably interconnecting said tooth and adapter relative to each other.

60. The multipiece excavating tooth assembly according to claim 51 wherein the upper longitudinally extending common edge joining the two angularly slanted and planar sides of said adapter has a radiused configuration.

61. A multipiece tooth assembly for a loader apparatus, said tooth assembly comprising:

an adapter having a base portion and a nose portion axially aligned relative to each other along a longitudinal centerline of the adapter, said base portion being configured to permit attachment of said adapter to said loader apparatus, and wherein said nose portion has four or less sides including top and bottom surfaces disposed above and below the longitudinal centerline of the adapter, respectively, with the upper surface of said nose portion having two angled and dependent generally planar sides joined to each other along a longitudinally extending common top edge extending forwardly from a rear end of and for a lengthwise distance along said nose portion, with each side of said upper surface being arranged on opposite lateral sides of the longitudinal centerline of said adapter and extending in annularly divergent directions relative to each other from said common top edge, and wherein said nose portion further defines a recess disposed along an axis extending generally normal to one of said sides of the top surface of said adapter;

a ground engaging tooth adapter to fit loosely on said adapter, said tooth having a forward end and a rearward end, with the rearward end of said tooth defining a socket open to the rearward end of said tooth and configured to coact with the angled dependent sides on the nose portion of said adapter such that the socket in the tooth and angled dependent sides on the nose portion of the adapter yield a self-centering effect to the tooth fitted on the adapter, said tooth further defining an opening disposed for operative combination with the recess in said adapter when said tooth and adapter are arranged in operative combination relative to each other; and retaining pin structure accommodated within the recess on said adapter and at least partially passing through the opening in said tooth thereby releasably connecting said tooth and said adapter in operable combination relative to each other.

62. The tooth assembly according to claim 61 wherein said bottom surface has a generally planar configuration extending generally parallel to a horizontal plane.

63. The multipiece excavating tooth assembly according to claim 61 wherein the common top edge from which the angled planar sides depend has a radiused configuration.

* * * * *